United States Patent [19]

Tindall

[11] Patent Number: 4,705,330

[45] Date of Patent: Nov. 10, 1987

[54] FLUID INJECTORS

[75] Inventor: David Tindall, South Ascot, England

[73] Assignee: Spectus Limited, Reading, England

[21] Appl. No.: 607,768

[22] Filed: May 7, 1984

[30] Foreign Application Priority Data

May 6, 1983 [GB] United Kingdom ..... 8312510

[51] Int. Cl.[4] ..... B05B 9/03

[52] U.S. Cl. ..... 239/125; 137/614.06; 251/149.9; 239/571; 239/574; 239/578

[58] Field of Search ..... 239/124, 125, 126, 533.2, 239/571, 574, 578; 251/149.9; 137/614.06

[56] References Cited

U.S. PATENT DOCUMENTS

| | | | |
|---|---|---|---|
| 1,700,073 | 1/1929 | Parker et al. | 251/149.9 |
| 2,263,913 | 11/1941 | Bargeboer | 158/36 |
| 2,334,679 | 11/1943 | Mason et al. | 158/36.3 |
| 3,144,075 | 8/1964 | Jackson | 239/126 |
| 3,211,178 | 10/1965 | Kiszko | 137/614.04 |
| 3,212,555 | 10/1965 | Schuss et al. | 158/36.3 |
| 3,423,063 | 1/1969 | German | 251/149.9 |
| 3,587,970 | 6/1971 | Tindall | 239/126 |
| 3,693,655 | 9/1972 | Frisk | 251/149.9 |
| 3,844,479 | 10/1974 | Needham | 239/125 |
| 4,378,090 | 3/1983 | Cohen et al. | 239/125 |
| 4,495,967 | 1/1985 | Needham et al. | 137/614.06 |
| 4,552,333 | 11/1985 | Niemi | 251/149.9 |

FOREIGN PATENT DOCUMENTS

| | | | |
|---|---|---|---|
| 1200023 | 12/1959 | France . | |
| 997864 | 7/1965 | United Kingdom . | |
| 1233317 | 5/1971 | United Kingdom . | |
| 2080703 | 7/1981 | United Kingdom . | |
| 2082088 | 3/1982 | United Kingdom | 239/125 |

*Primary Examiner*—Andres Kashnikow
*Assistant Examiner*—Michael J. Forman
*Attorney, Agent, or Firm*—Renner, Kenner, Greive, Bobak & Taylor

[57] ABSTRACT

A tip shut-off fluid injector F has its injection device 1 inset to a fixed female interlocking terminal 2 when in the firing position with which a change-over valve 4 is connected by pipes P or is made integral. The terminal 2 includes valves 8 and 9 and, optionally, a by-pass valve 10. A gearbox 12 connects between the valves 8, 9 and 10 and a handwheel 11. Rotation of the handwheel 11 inserts or retracts the injection device 1 to or from the firing position and also, via the gearbox 12, rotates the valves 8, 9 and 10 between open and closed positions. Before the injection device 1 can be retracted, the handwheel 11 must be initially rotated to rotate the valves 8 and 9 to closed positions to isolate the fluid supply from the injection device 1 and, optionally, to open the by-pass valve 10 to allow fluid to circulate from the supply through the terminal 2 back to return. Conversely, it is not until the injection device 1 is inserted that the valves 8 and 9 can be rotated by the handwheel 11 to open positions to communicate the fluid supply with the injection device 1 and, optionally, close the by-pass valve 10. The change-over valve 4 may include a direct flow path interconnecting the fluid supply and return when the injection device 1 is retracted. Other kinds of fluid injectors incorporating the invention are envisaged.

24 Claims, 32 Drawing Figures

FLUID INJECTORS

This invention concerns improvements in or relating to fluid injectors.

According to the invention there is provided a fluid injector comprising an injection device, means for fluid connection to a fluid delivery line external to said fluid injector, said injection device being removably mounted relative to said fluid connection means, valve means for controlling fluid communication between said fluid connection means and said injection device, and actuator means serving two functions one of which in an initial movement of said actuator means is to move said valve means to a position at which said valve means will fluidly isolate said fluid connection means from said injection device and the other function of which in a continued movement of said actuator means is to effect removal of said injection device from an operating position and relative to said fluid connection means, said continued movement being possible only after said valve means has been moved to said isolate position.

In a preferred fluid injector constructed in accordance with the invention, said actuator means serves two further functions one of which in a second initial movement of said actuator means is to effect insertion of said injection device relative to said fluid connection means to said operating position and the other of which in a second continued movement of said actuator means is to move said valve means to a position at which said valve means will fluidly communicate said fluid connection means with said injection device, said second continued movement being possible only after said injection device has been moved to said operating position.

Those who are familiar with the application of fluid injectors to oil burners will be aware of the need to isolate safely the fuel oil terminals which connect to and individual fluid injector (from a ring main or system supplying fuel oil to a plurality of oil burners) before that fluid injector is removed for maintenance or for any other reason.

In a simple arrangement, a single pipe connects from the fuel oil delivery manifold to a pressure jet fluid injector, and a simple hand operated on-off valve is provided between the manifold and the fluid injector. Thus, to remove the fluid injector, the maintenance technician selects the valve to "off" and thereby isolates the supply of fuel oil from the fluid injector: for this reason these valves are termed isolating valves. Similarly, a tip shut-off type of fluid injector may be isolated from the fuel oil delivery and return manifolds by the maintenance technician selecting two appropriate isolating valves, one for each manifold, to an "off" position.

It will be readily appreciated that a hazard to operator safety and plant security arises if the isolating valves are opened while the fluid injector is removed. For this reason, many public authorities have introduced procedures to lock valves in the closed position, but while keys exist this method is not regarded as foolproof.

Manufacturers have developed a number of intended solutions such as spring operated valves. Thus, if a fluid injector is removed, springs push valves into mating seats thereby effecting a closure or isolation of the appropriate fuel terminals. These "self sealing valves" as they are sometimes called are a part solution. Indeed, they have been accepted by many authorities as a solution for any requirement to isolate a fuel oil terminal automatically when a fluid injector is removed.

However, self sealing valves have been known to jam in the open position. A number of causes which prevent self sealing valves closing can be identified. If springs are heated they lose their temper and powers of restitution. Springs can work harden and fracture. In the event of any foreign body interposing between a valve and its mating seat the valve remains open. In other words a spring is not "positive": it can be deformed, deconditioned, restrained or interrupted. Since in self sealing valves the spring is an internal component, it can fail with no external indication or mechanism acting to prevent the safe removal of a fluid injector. It may be postulated, therefore, that spring operated valves are not suitable for the safe isolation of fuel terminals.

A hand operated valve such as a ball valve or any of the many commercially available manual valves is more suitable as an isolating valve because the valve is connected to its operating handwheel, lever or other external operating device, by a rigid and integral member. Thus, if for example, any foreign body interposes between the valve and its mating seat, operation of the closure mechanism is prevented.

It is now a requirement by users of oil burners and fluid injectors that the fluid injector (sometimes called a "burner assembly") is so designed as positively to ensure that the fluid injector cannot be disconnected with the fuel oil supply on, and that fuel oil cannot flow to the oil burner unless the fluid injector is in the firing position.

As will be explained hereinafter, a preferred embodiment of the invention provides a positive mechanical interlock relating operation of such a closure mechanism to the removal of the fluid injection device by which those requirements are met.

The preferred positive mechanical interlock has the following features:

(i) the valve which is operated to isolate a fuel oil terminal is connected to the operating mechanism by a rigid member which is, in turn, an integral part of the valve and the operating mechanism;

(ii) the operating mechanism is interlocked to the fluid injection device so that the isolating valves can only be opened with the injector insert to the firing position;

(iii) the operating mechanism is interlocked to the fluid injection device so that the injector can only be removed when the isolating valves have been closed;

(iv) the means to position the operating mechanism for connection or disconnection of the fuel oil terminal to or from the fluid injection device are the same means as is employed to inset or remove the injector to and from the firing position; and (v) the fluid injector incorporates a key which facilitates positioning the operating mechanism which in turn opens or closes the isolating valves, so that without using the fluid injector itself as a key, it is not possible to operate the isolating valves.

In known arrangements, selecting the isolating valves to an "off" position prevents the continued passage of oil through the pipe connecting from the fuel oil delivery and return manifolds to a fluid injector of the tip shut-off type. Thus, circulation ceases and the oil becomes static in the connecting pipes. In circumstances in which fuels are pumpable at ambient temperatures, when the isolating valves are restored to the "on" position such fuel oils will resume circulation without difficulty. In the case, though, of those fuels which have to be heated to make them pumpable, when the isolating valves are selected to the "off" position the fuel oil cools down eventually to solidify in the connecting pipes. Thus, such fuel oils will not resume circulation and the fluid injector will fail to operate and be rendered susceptible to damage. As fuels which require heating to make them pumpable are increasingly fired through oil burners, it is of distinct advantage if the fuel oil terminal into which a fluid injector is inset can be arranged so that when the isolating valves are set to the "off" position, a by-pass valve can be opened to permit the fuel oil to continue to flow through the connecting pipes. This facility may be termed the provision of automatic circulation.

In UK-A-2,080,703, a device is described which may be applied to various fluid injectors. One such arrangement for a tip shut-off fluid injector provides automatic circulation facilities which are combined with spring operated valves to isolate the connecting pipes from the fluid injector upon its retraction from the firing position. This earlier invention was seen as a partial solution to the problem but it is incomplete in so far as it does not provide a positive mechanical interlock.

The present invention may be applied to various fluid injectors. In accordance with a preferred embodiment of the invention, automatic circulation right up to the fluid injector terminals is combined with a positive mechanical interlock in a tip shut-off fluid injector. One such injector to which the invention may be applied has a changeover valve which connects to a fluid delivery and return circuit as featured in UK-A-1,233,317 and UK-A-1,231,631.

Another fluid injector to which the invention may be applied is one of the pressure jet type which is mechanically atomised and incorporates a fluid atomiser at the discharge end and an operating valve which connects to a fluid delivery and return circuit.

A third fluid injector is a multi-fluid injector with a tip shut-off facility which is atomised by a second fluid and includes a means to select discharge of either fluid or a mixture of the fluids and includes a change-over valve which connects to a fluid delivery and return circuit. Such an injector is featured in UK-A-1,497,271.

A fourth fluid injector is one that is second fluid atomised and which has an operating valve which connects to a fluid delivery and return circuit.

In order that the invention may be well understood there will now be described some preferred embodiments thereof, given by way of example, with reference to the accompanying drawings, in which.

In the various figures, like references indicate like parts.

Each of the fluid injectors to be described is primarily intended for incorporation in an oil fuel burner suitable for use in a water boiler. Such burners are arranged in the furnace walls of the boiler for firing the boiler's fuel. Oil fuel is used as the prime fuel for firing boilers or as a secondary fuel for igniting coal when that is the primary fuel, or in combination with gas as an alternative primary fuel. The boiler would generate steam, and have land, marine or other industrial applications.

The tip shut-off fluid injector F shown in FIGS. 1 to 4 has a considerable degree of similarity to that illustrated in FIGS. 1 to 7 of UK-A-2,080,703 but is improved thereover in that it incorporates the positive mechanical interlock. The same comment applies to the pressure jet fluid injector $F_1$ shown in FIGS. 7 herein related to that of FIGS. 12 and 13 of UK-A-2,080,703. Further, the multi-fluid injector $F_2$ of present FIGS. 8 is similar to that of FIGS. 9 to 11 of UK-A-2,080,703 apart from the improvement comprising the positive mechanical interlock. Whilst the present disclosure is believed adequately to disclose the invention now made, attention is directed to UK-A-2,080,703 for a full and complete disclosure when read in conjunction with UK-A-1,231,631, UK-A-1,233,317 and UK No. 1,497,271 (which are addressed more specifically to the construction and operation of the tip-shut off valve, the changeover valve and a second fluid injector to regulate discharge) the subject matter thereof being incorporated herein by reference.

Figure 1A:
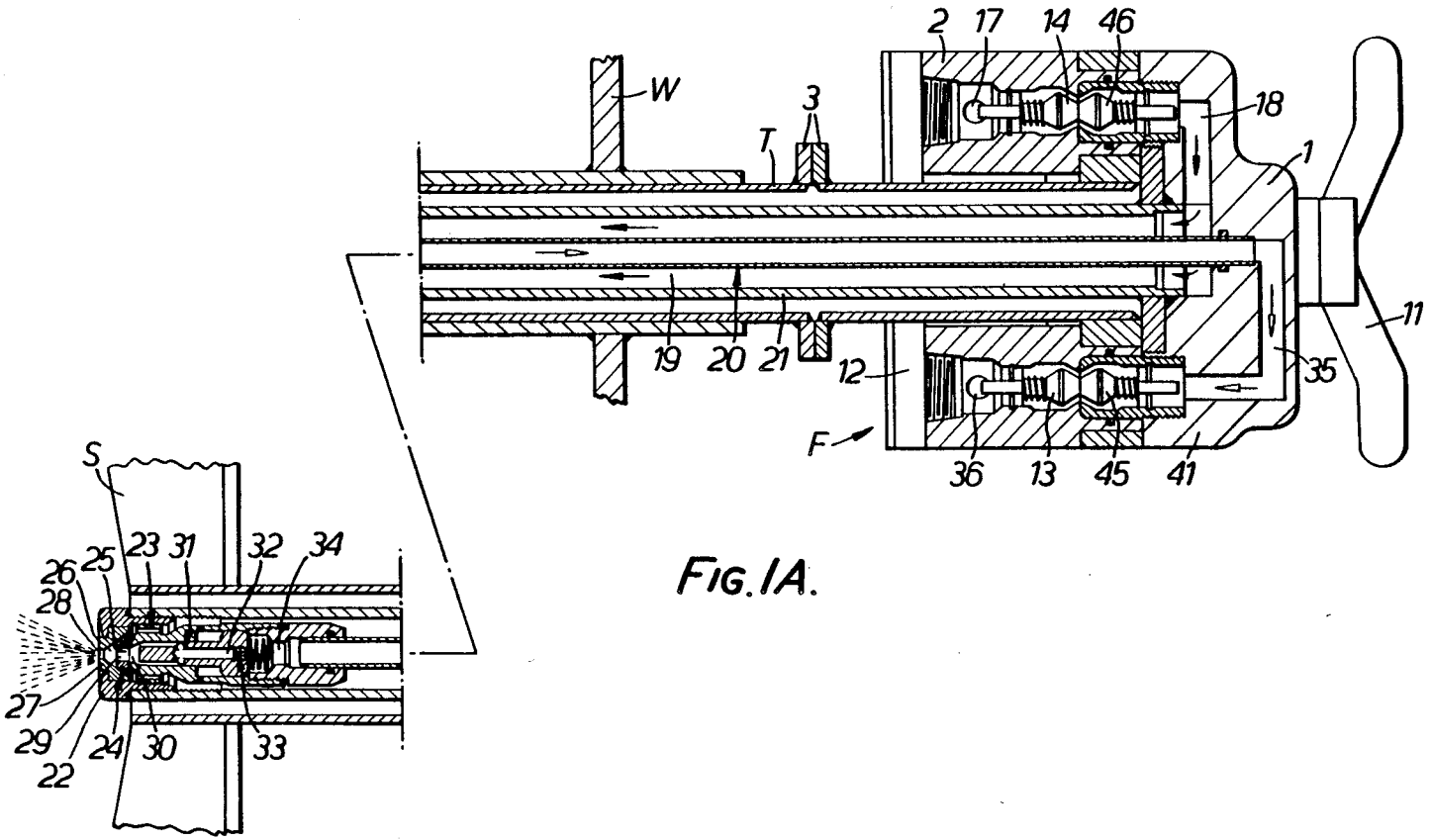
FIGS. 1A, 1B and 1C are a part-sectioned plan view, side elevation and end elevation, respectively, of a tip shut-off fluid injector secured in the operating position and conditioned for fluid discharge, the injector incorporating a positive mechanical interlock.
Figure 1B:
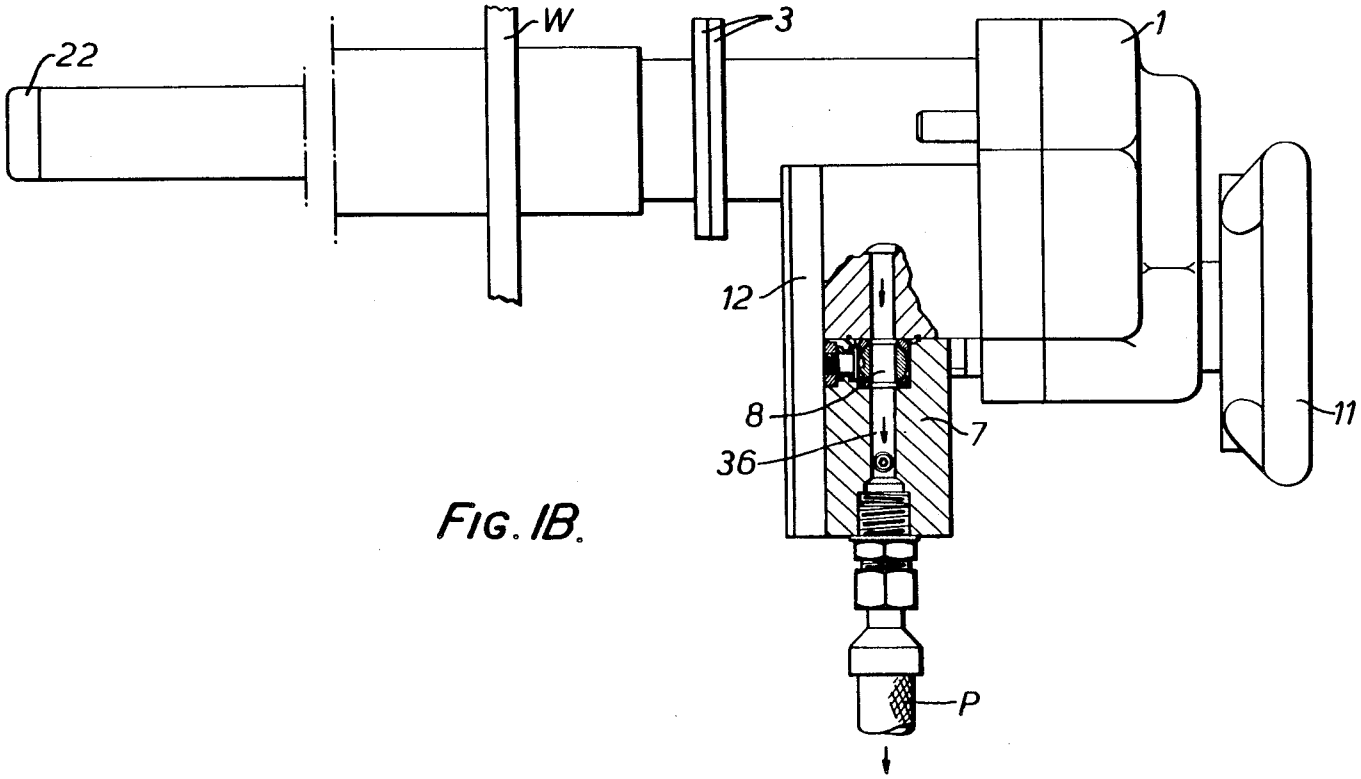
Figure 1C:
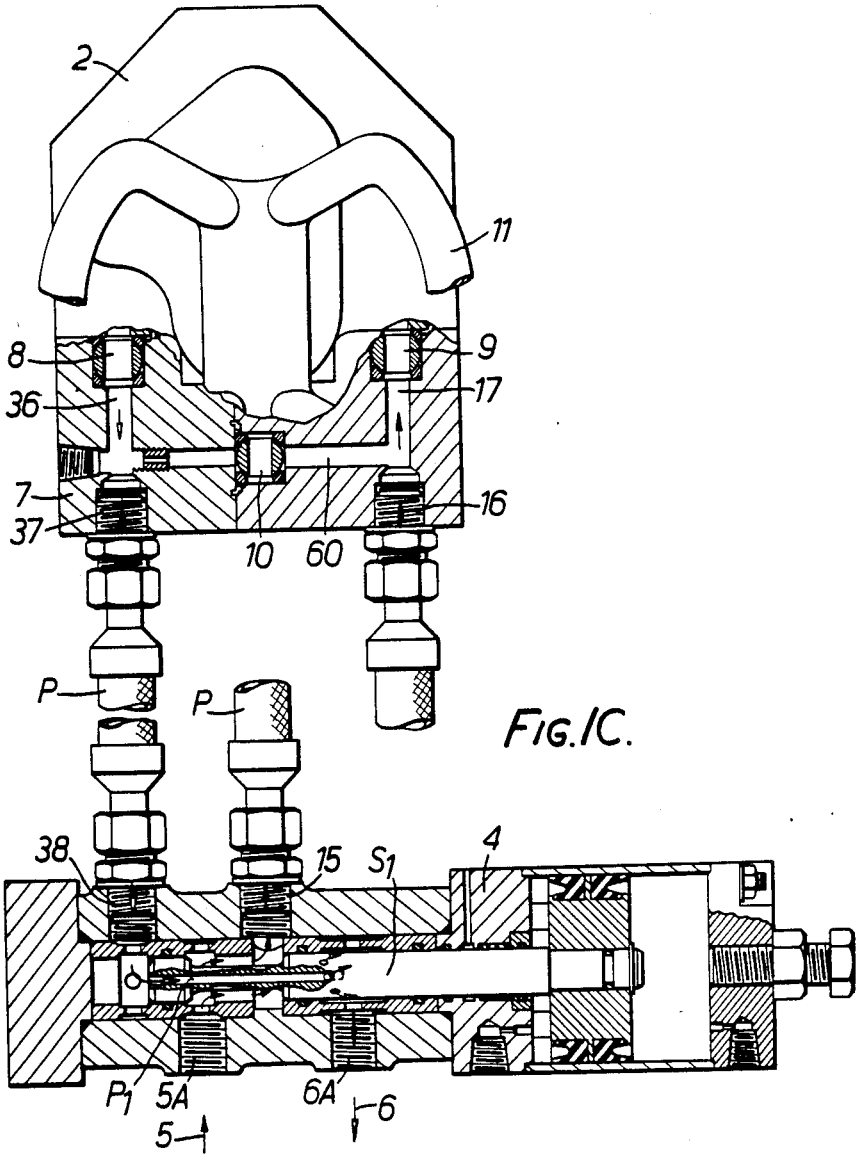
Figure 2A:
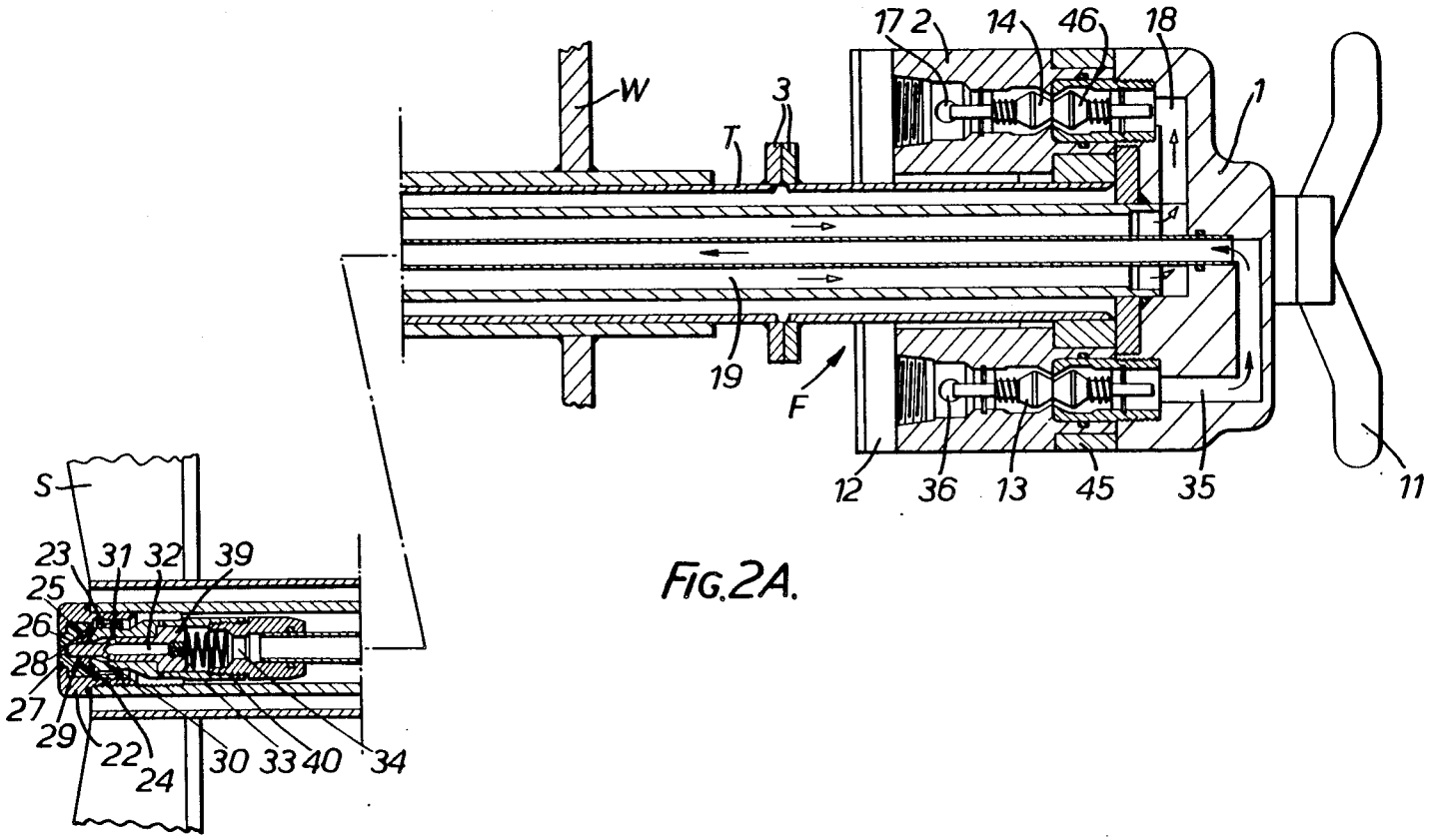
FIGS. 2A, 2B and 2C are a part-sectioned plan view, side elevation and end elevation, respectively, of the same fluid injector secured in the operating position but conditioned for non-fluid discharge.
Figure 2B:
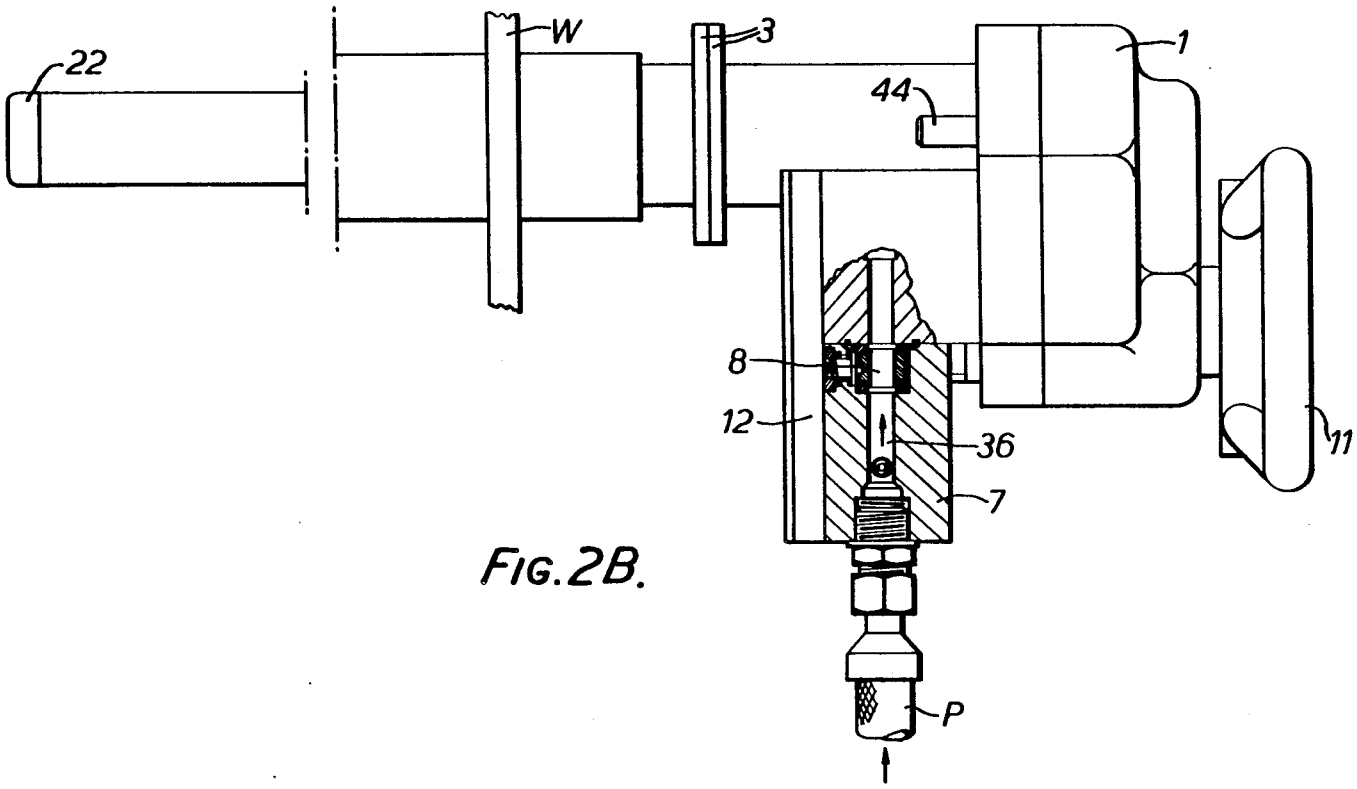
Figure 2C:
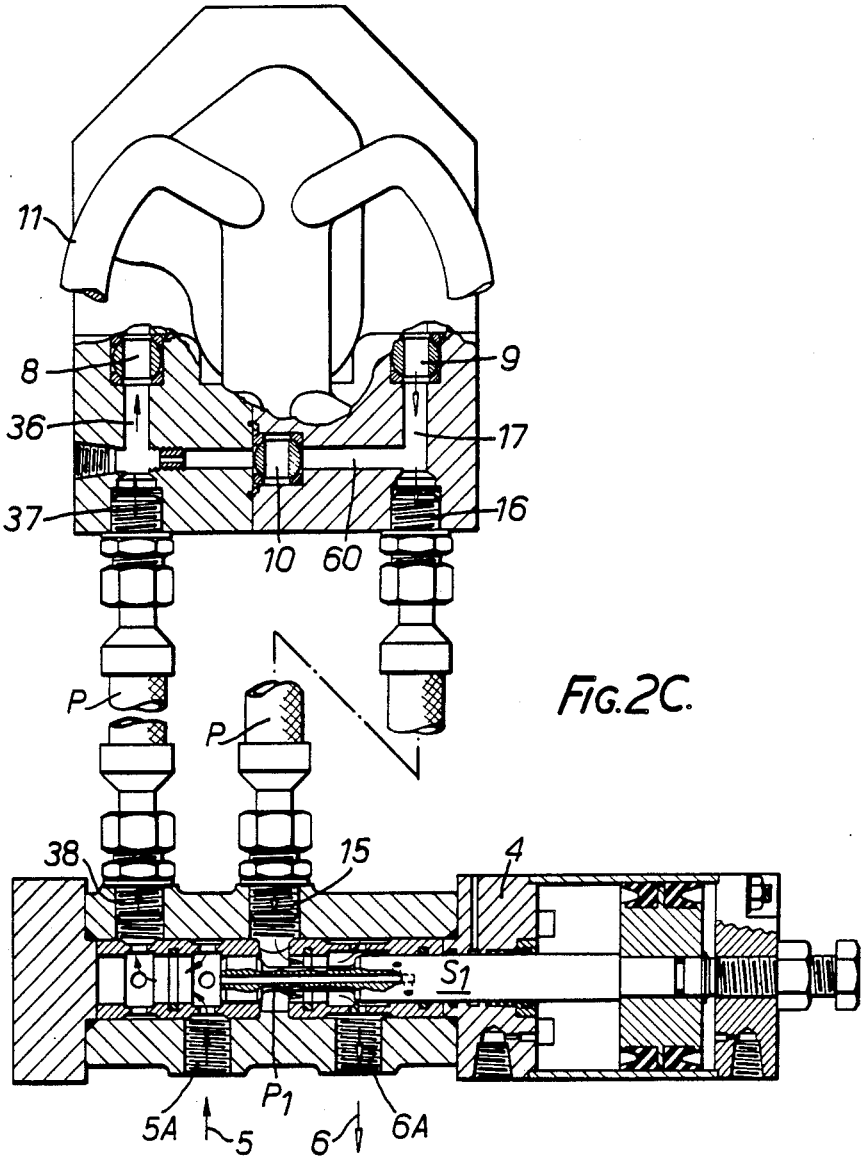

Referring first to FIGS. 1 and 2 a fluid injector F of the tip shut-off type has its injection device 1 inset to a female interlocking terminal 2 which is fixed via flanges 3 to an oil burner carrier tube T carrying at its forward end a flame stabiliser S. The carrier tube T is attached to the boiler wall W such that when the injection device 1 is inset to the female terminal 2 the injection device is positioned so as to facilitate discharging fluid into the boiler furnace where it is combusted. This position of the injection device 1 is commonly known as the firing position.

Contrary to UK-A-2,080,703, a change-over valve 4 of the fluid injector F is not made integral with the female terminal 2 (although it could be if wished), but, rather, two pipes P connect the female terminal with the housing of the changeover valve which, in turn, is connected to fluid delivery 5 and fluid return 6 circuits. The changeover valve 4 is provided to condition the fluid injector F for discharge or non-discharge of fluid.

A terminal valve block 7 houses two fluid terminal isolating valves 8 and 9 and a by-pass valve 10, and is integral with the female terminal 2 to isolate the valves 8 and 9 and to provide automatic circulation of fluid through the fluid injector F from the fluid delivery circuit 5 back to the fluid return circuit 6 when the injection device 1 is retracted from the firing position.

A handwheel 11 is used to insert or retract the injection device 1 to or from the firing position. The handwheel 11 is keyed to a gearbox 12 which is integral with the valve block 7 and which connects from the handwheel to operate the fluid terminals isolating valves 8 and 9 as well as the by-pass valve 10. Thus operation of the handwheel 11 to position the injection device 1 also selects the fluid terminals isolating valves 8 and 9 for "on" or "off" to facilitate the connection or termination respectively of the fluid supply before the injection device 1 is inserted or retracted. To retract the injection device 1, the gearbox 12 operates so that at the same time as the fluid supply terminates then the by-pass valve 10 opens to allow automatic circulation of the fluid through the terminal valve block 7.

The means employed to key the fluid injector handwheel 11 into the gearbox 12 are arranged in two steps so that operation of the handwheel inserts the injection device 1 to the firing position before opening the fluid terminal isolating valves 8 and 9 to connect the fluid injector to the fluid delivery and return circuits 5 and 6, respectively. Conversely, before the injection device 1 may be retracted from the firing position, the fluid terminal isolating valves 8 and 9 must first be closed. Selection of the fluid terminal isolating valves 8 and 9 to "on" or "off" acts through the gearbox 12 and automatically closes or opens the by-pass valve 10.

Two spring operated self closing valves 13 and 14 may be provided in the female interlocking terminal 2 and arranged to close when the injection device 1 is withdrawn thus double isolating the fluid delivery and return circuits 5 and 6.

In FIG. 1 the fluid injector F is shown to be in the firing position and conditioned for fluid discharge. Fluid from the fluid delivery circuit 5 enters the changeover valve 4 at a port 5A. The changeover valve 4 is shown selected to the position which conditions the fluid injector F for fluid discharge. With the changeover valve 4 selected to condition the fluid injector F for fluid discharge, the fluid is directed from the port 5 out of the changeover valve through a port 15 and enters the terminal valve block 7 through a port 16. From the port 16, the fluid passes along a duct 17 and through the fluid terminal isolating valve 9 into the female interlocking terminal 2, to the spring operated valve 14 therein. From the valve 14, fluid enters a duct 18 formed in a male interlocking terminal 41 forming part of the injection device 1. The fluid then flows into an annular duct 19 formed between a central tube 20 and an outer tube 21 of the injection device 1. The terminal 41 is made integral with the outer tube 21. From the annulus duct 19, the fluid passes through a tip valve assembly 22 via holes 23 and ducts 24 in a swirl plate 25 into a chamber 26 formed between the swirl plate and an orifice plate 27. Fluid is discharged from the chamber 26 through a hole 28 in the orifice plate 27 to form a finely atomised spray in a region forward of the fluid injector F.

With the fluid injector F so conditioned for fluid discharge, some of the fluid entering the chamber 26 may be returned to the fluid return circuit 6 via a hole 29 in the swirl plate 25 which connects to a chamber 30 next passing via a fluid pressure differential operated tip sealing valve 39 through holes 31, 32 and 33 therein into a chamber 34. From the chamber 34, the fluid flows into the central tube 20 returning via a duct 35 in the male terminal 41 through the spring operated valve 13 and the fluid terminal isolating valve 8 into a duct 36 in the valve block 7 to exit through a port 37 and enter the changeover valve 4 at a port 38. From the port 38, fluid is directed through a passageway $P_1$ in the spool $S_1$ of the changeover valve 4 to discharge into the return circuit 6.

In FIG. 2 the fluid injector F is shown to be in the firing position but conditioned for fluid non-discharge. The means to select the fluid injector for fluid non-discharge is provided by the changeover valve 4. It will be seen that the changeover valve spool $S_1$ has been moved rearwardly so that fluid from the fluid delivery circuit 5 enters the changeover valve at the port 5A to be directed out of the changeover valve through the port 38 to enter the terminal valve block 7 through the port 37. From the port 37, the fluid passes along the duct 36 and through the fluid terminal isolating valve 8 to the spring operated valve 13. From the valve 13, the fluid enters the duct 35 and flows into the central tube 20 to act on the rear face of the tip valve 39 which slides as a piston in a cylinder 40 and moves forwardly to close the orifice 28 by making a seal between the forward face of said piston 39 and the rearward face of the orifice plate 27. Some fluid is allowed to flow through the piston 39 via the holes 33, 32 and 31 into the chamber 30 thence to flow through the hole 29 into the chamber 26. From the chamber 26, fluid may return to the fluid return circuit 6 via the ducts 24 in the swirl plate 25 and the holes 23 into the annular duct 19. From the annular duct 19, the fluid flows through the duct 18 and the spring operated valve 14 to the fluid terminal isolating valve 9, and into the duct 17 to leave the terminal valve block 7 through the port 16 and re-enter the changeover valve 4 at the port 15. From the port 15, the fluid is directed through the said changeover valve to discharge therefrom at a port 6A into the return circuit 6.

As will be realized, when the fluid injector F is in the firing position but conditioned for non-discharge, fluid will continuously circulate through it up to the tip valve 39 thereby to cool the forward region of the injection device 1 and obviate the need for it to be retracted away from the boiler interior. Because of such continuous circulation, fuel cracking and blockage in the injector is obviated, and there is no necessity for cleaning between discharge operations.

Figure 3A:
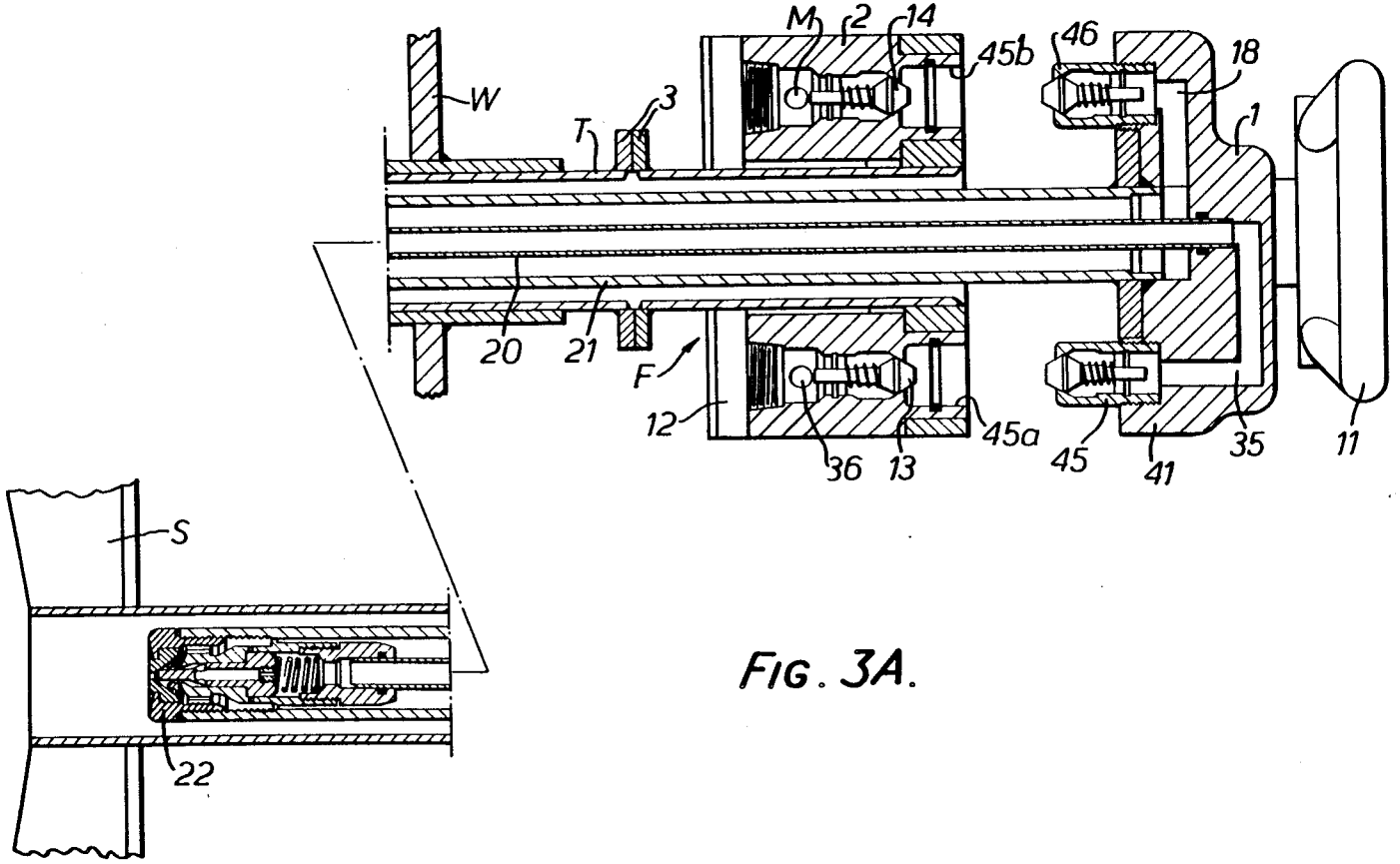
FIGS. 3A, 3B and 3C are a part-sectioned plan view, side elevation and end elevation, respectively, of the same fluid injector with its fluid injection device retracted from the operating position.
Figure 3B:
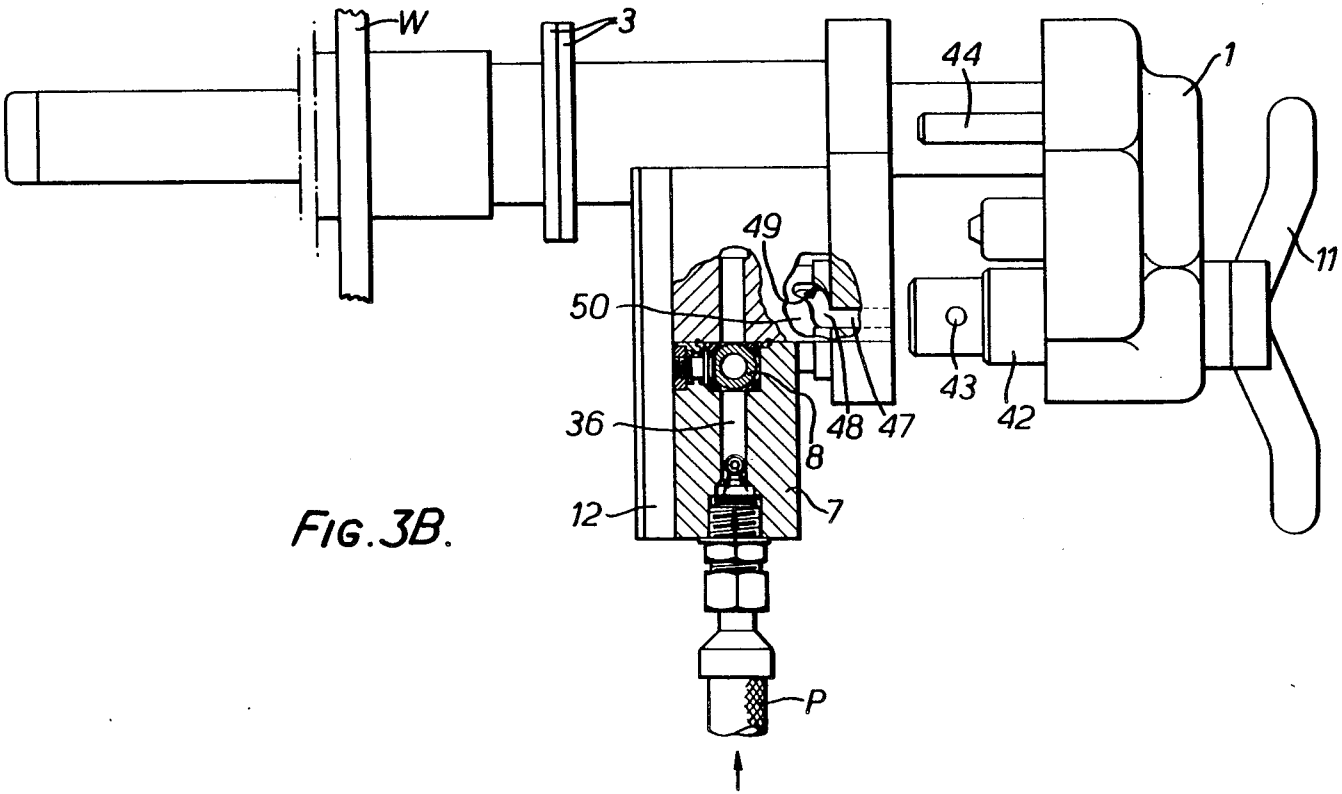
Figure 3C:
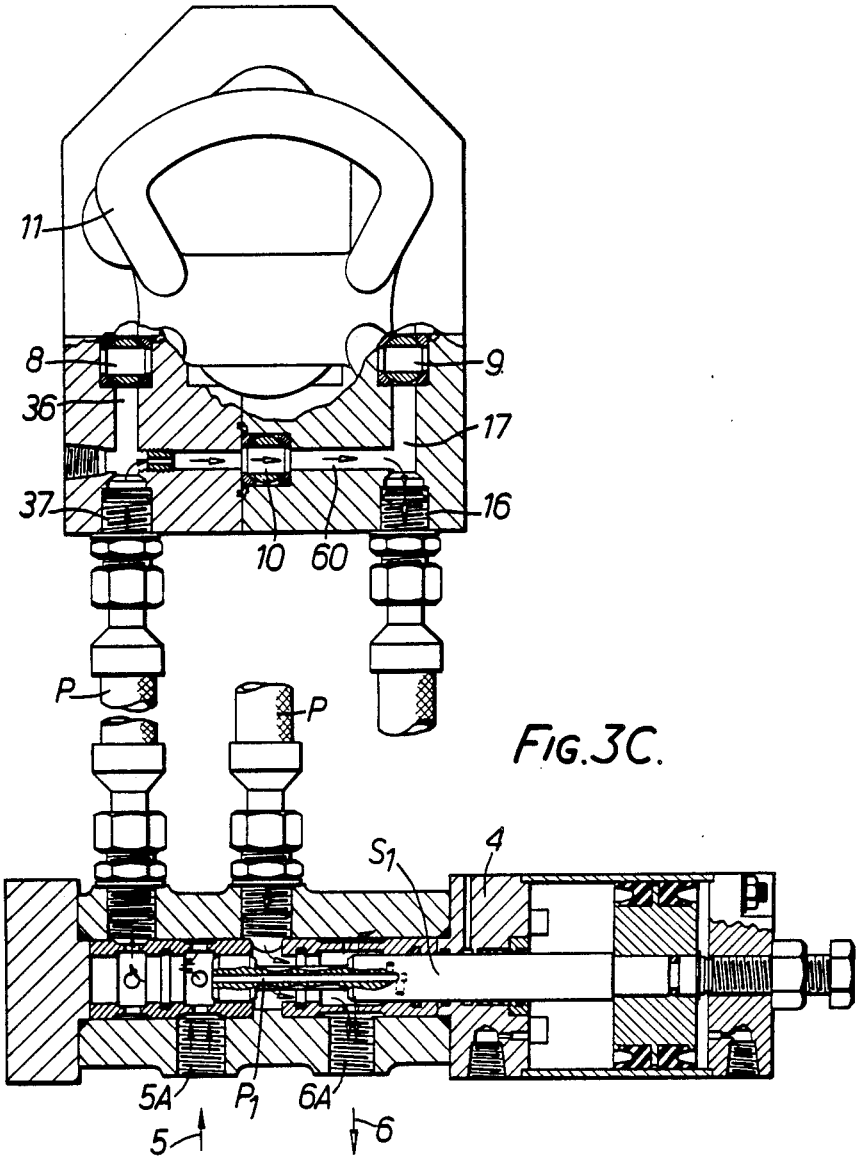

By reference to FIG. 3, it will be seen that the changeover valve 4 has been selected to condition the fluid injector F for fluid non-discharge and the injection device 1 has been retracted from the firing position.

The injection device 1, as aforesaid, comprises the tip valve assembly 22 and two tubes, a central tube 20 and an outer tube 21, which connect the tip valve assembly to the male interlocking terminal block 41. The central tube 20 is disposed coaxially inside the outer tube 21 to form the annular duct 19 between the two tubes. The handwheel 11 is keyed in permanent rigid connection to a handwheel shaft 42 journalled for rotation in and projecting through the male terminal block 41 and being held captive in said block by the handwheel. The handwheel shaft 42 includes an interlocking key 43 in the form of a drive pin which rotates upon rotation of the handwheel 11. The drive pin 43 extends through and projects radially from the shaft 42 in diametrically opposite directions. The male terminal block 41 includes two guide rods 44 and two male terminals 45 and 46 which connect, respectively, to the ducts 35 and 18. These terminals may contain spring operated self closing valves similar to those provided in the female interlocking terminal 2.

To insert the injection device 1 to the firing position, it is manually lifted by grasping the handwheel 11 to engage the guide rods 44 slidably in matching holes in the female interlocking terminal 2. The guide rods 44 take the weight of the male terminal block 41 which may then be pushed forward into the female interlocking terminal 2 by disposing the handwheel 11 to permit the interlocking key 43 to enter the female interlocking terminal by insertion in keyways therein defined by two diametrically opposite slots 47 extending from a bore in that terminal which receives the entered handwheel shaft 42. As the injection device 1 moves forward the male terminals 45 and 46 engage slidably mating receiving bores 45*a* and 45*b* in the female interlocking terminal 2 and at the position at which they engage the female spring operated self closing valves 13 and 14 the interlocking key 43 passes through the interlocking terminal to enter a slot 48 formed between a land 49 on an integral part of the rearward face of the terminal 2 and between an interlocking shaft 50. The handwheel 11 and the interlocking key 43 are thus engaged in the female interlocking terminal 2 so as to rotate therein.

Figure 4A:
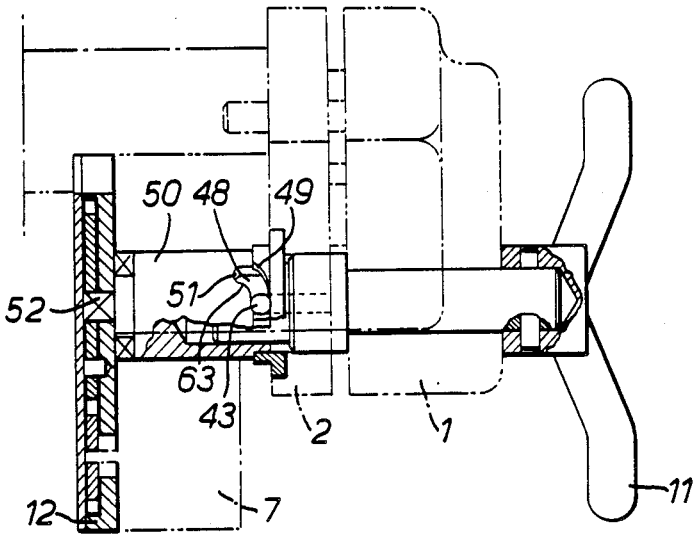
FIGS. 4A and 4B are a fragmentary part-sectioned side elevation and end elevation, respectively, of the same fluid injector showing the gear box and interlocking drive for the positive mechanical interlock thereof, with the gear box positioned to select the fluid terminal isolating valves to isolate the fluid injection device from the fluid delivery and return circuits.
Figure 4B:
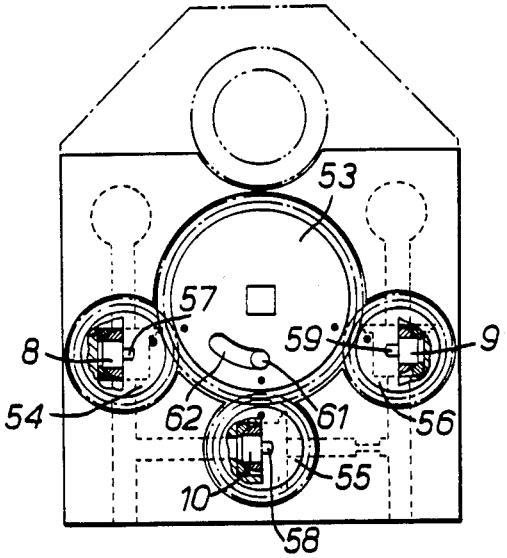
Figure 4C:
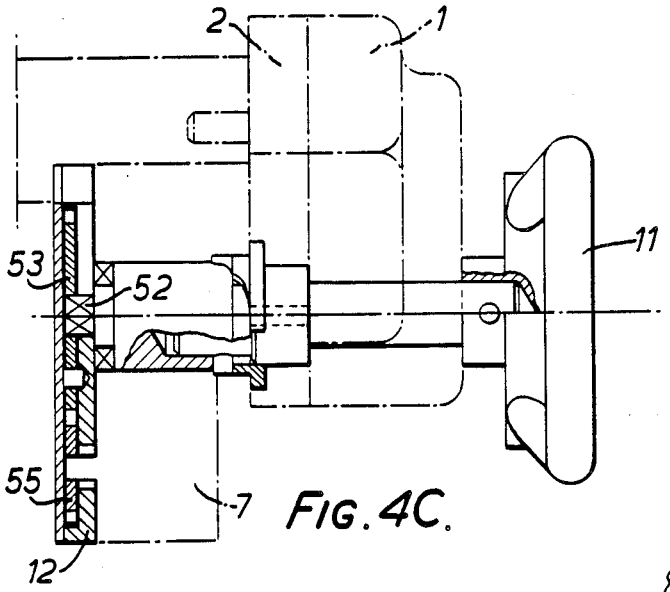
FIGS. 4C and 4D are views similar to FIGS. 4A and 4B, respectively, but with the gear box positioned to select the fluid terminal isolating valves to connect the fluid injection device to the fluid delivery and return circuits.
Figure 4E:
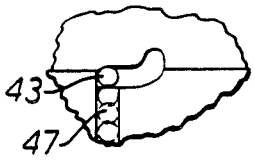
FIGS. 4E, 4F and 4G illustrate details of the same interlocking drive with the interlocking key thereof in different positions.
Figure 4D:
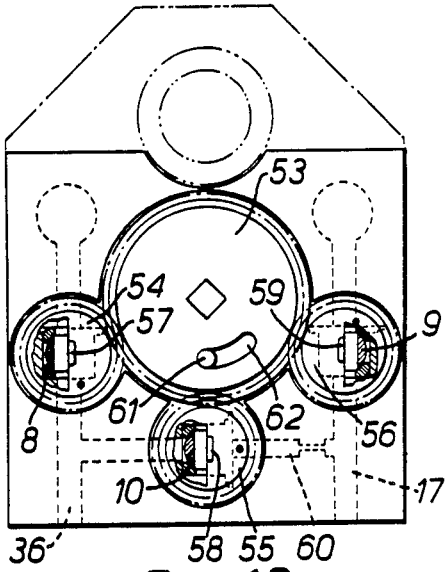
Figure 4F:
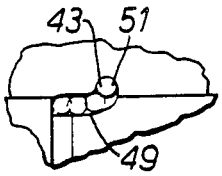
Figure 4G:
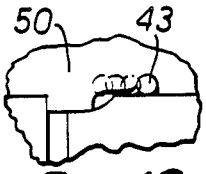

FIG. 4A shows in greater detail the gearbox 12. From this figure it will be seen that to insert the injection device 1 into the female interlocking terminal 2 it is first necessary to engage the interlocking key 43 therein so that it may be rotated. Rotation of the handwheel 11 in a clockwise (facing the handwheel) direction causes the interlocking key 43 to bear on the fixed land 49 which is rising so that as the handwheel rotates the land causes the interlocking key to move from the FIG. 4E position forwardly along the axis of the female interlocking terminal 2 to insert the injection device 1 to the firing position. As the interlocking key 43 moves forwards it slides into the slot 48 formed between the rising land 49 and the interlocking shaft 50 until as the injection device 1 attains the firing position the interlocking key engages an extension of the slot 48 which is developed into the interlocking shaft to form a drive keyway 51 as shown in FIG. 4F. Thus, the injection device 1 is inserted to the female interlocking terminal 2 and located in the firing position and the interlocking key 43 is engaged in the interlocking shaft 50 and bearing on the drive keyway 51 so that further rotation of the handwheel 11 will cause the interlocking key 43 to rotate the interlocking shaft in a clockwise direction as shown in FIG. 4G.

The interlocking shaft 50 incorporates a square key 52 at its forward end which is in permanent engagement with a gearwheel 53 which in turn is in permanent engagement with gearwheels 54, 55 and 56 as shown in FIGS. 4A to 4D. The interlocking shaft 50 is held captive between the female interlocking terminal 2 and the gearbox 12, and the gearwheels 53 to 56 are held captive in the gearbox and arranged in a manner commonly known as a sun and planets arrangement. The gearwheel 53 is the sun gear and the gearwheels 54, 55 and 56 are the planet gears. The planet gears 54, 56 and 55 in turn are respectively in permanent rigid engagement with the fluid terminal isolating valves 8 and 9 and the by-pass valve 10 acting through drive members 57, 59 and 58. The gearbox 12 is arranged to connect the planet gear 54 through the drive member 57 to the isolating valve 8, the planet gear 55 connects through the drive member 58 to the by-pass valve 10, and the planet gear 56 connects through the drive member 59 to the isolating valve 9.

Thus, further operation of the handwheel 11...through an additional 45 degrees . . . will rotate the interlocking shaft 50 in a clockwise direction at the same time turning the sun gear 53 which in turn rotates the planet gears 54, 55 and 56 to select the fuel terminal isolating valves 8 and 9 to the "on" position thereby connecting the fuel supply and return circuits to the injection device 1 and simultaneously selecting the by-pass valve 10 to the "off" position to close off the automatic circulation through a cross connecting duct 60. Further clockwise rotation of the handwheel 11 is prevented by a fixed pin 61 which projects into a slot 62 cut in the sun gear 53. The fixed pin 61 is fixed to the gearbox 12 and disposed to project into the slot 62 so that rotation of the sun gear 53 is restricted to prevent further rotation of the sun gear when the fuel terminal isolating valves 8 and 9 have been selected for the "on" position. The sun gear 53 is in permanent engagement with the interlocking shaft 50, and the interlocking key 43 is engaged to the interlocking shaft and held in place by the raised part of land 49 on the rearward face of the terminal 2 preventing further clockwise rotation of the handwheel 11, or axial slidable movement of the handwheel. The injection device 1 is thereby inserted to the firing position and locked in place, and by operation of the changeover valve 4 the fluid injector F may be safely selected for fluid discharge or fluid non-discharge.

To retract the injection device 1 from the female interlocking terminal 2, the handwheel 11 is operated to rotate in an anti-clockwise direction. Turning the handwheel 11 causes the interlocking key 43 to bear on the drive keyway 51 which in turn rotates the interlocking shaft 50 in an anti-clockwise direction. The interlocking shaft 50 rotates the sun gear 53 which, in turn, rotates its planet gears 54, 55 and 56 to select the fluid terminal isolating valves 8 and 9 to the "off" position and simultaneously selecting the by-pass valve 10 to the "on" position thereby automatically causing the fluid to cross-connect from the fluid delivery circuit 5 to the fluid return circuit 6 via the duct 60. Further rotation of the sun gear 53 and interlocking shaft 50 is prevented by the fixed pin 61 bearing on the sun gear through the slot 62. The resistance to the rotation of the sun gear 53 does not prevent the continuing anti-clockwise rotation of the handwheel 11 through a further 45 degrees. The sun gear 53, as previously explained, is in permanent engagement with the interlocking shaft 50, and the pin 61 therefore prevents the interlocking shaft from rotating and at this point the interlocking key 43 disengages from the interlocking shaft. Thus, continued rotation of the handwheel 11 is permitted, and the interlocking key enters the slot 48 formed between the land 49 and the interlocking shaft 50. In anti-clockwise rotation the land 49 is falling and the interlocking key 43 bears on a land 63 which is part of the interlocking shaft 50 causing the injection device 1 to move in a rearward direction along the axis of the female interlocking terminal 2. Further anti-clockwise rotation of the interlocking key 43 is prevented when it is deflected from the slot 48 into the keyways defined by the two slots 47 in the female terminal 2. The injection device 1 may next be retracted or completely removed by grasping the handwheel 11 and pulling the injection device in a rearward direction.

It is important to take the point that before the injection device 1 can be retracted or completely removed from the female interlocking terminal 2, the interlocking shaft 50 must complete its travel as defined by the fixed pin 61 acting in the slot 62 before the interlocking key 43 is deflected from the slot 48 into the keyways defined by the two slots 47 in the female interlocking terminal 2 and which permit the retraction of the injection device because it is this rotation that closes the fluid terminal isolating valves 8 and 9 and these valves must therefore be fully closed before the injection device can be withdrawn. Thus, if a foreign body interposes to prevent the isolating valves 8 and 9 closing then, because the handwheel 11 is in rigid connection to the valve drive members 57 and 59 through the interlocking key 43 and the interlocking shaft 50 and the interlocking key has not completed its rotation, the interlocking key is unable to enter the keyways 47 so that it is not possible to withdraw the injection device 1 from the firing position.

It should also be noted here that the only means available to open the fluid terminal isolating valves 8 and 9 is the interlocking shaft 50, and this can only be operated by the interlocking key 43 which is an integral part of the injection device 1. Thus, the fluid terminal isolating valves 8 and 9 can only be opened with the injection device 1 inset to the firing position and engaged in the female interlocking terminal 2. It is considered that the interlock could only be defeated by special tools requiring special knowledge and skills, and this invention is therefore a significant contribution to operator safety and plant security.

It will now be seen that a positive mechanical interlock has been provided in the fluid injector having the aforementioned features. The fluid injector also has the facility of "automatic circulation": both through the change-over valve spool to allow fuel oil continuously to circulate through the fluid injector from the fuel delivery back to the return circuit and also through the valve block of the female terminal assembly, thereby obviating lengthy dead legs of oil which otherwise could exist to the detriment of the injector on start-up.

Figure 5A:
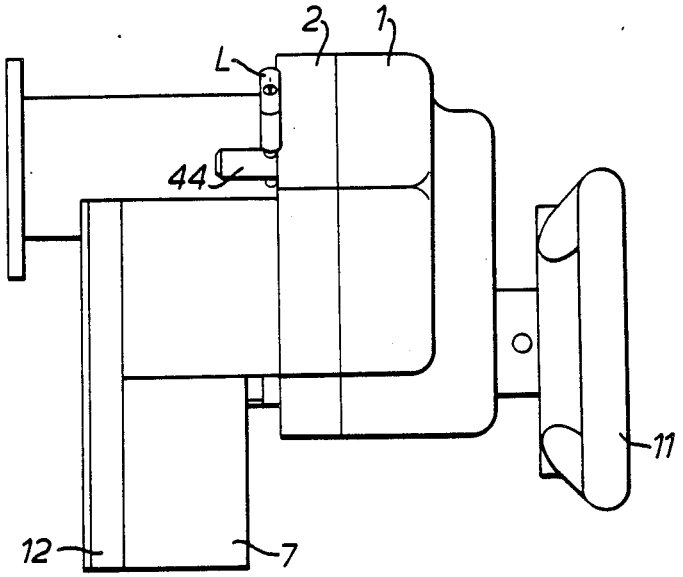
FIGS. 5A and 5B are fragmentary side and end elevations, respectively, of the same fluid injector with its fluid injection device padlocked in the firing position and with limited operation of the handwheel permitted.
Figure 5B:
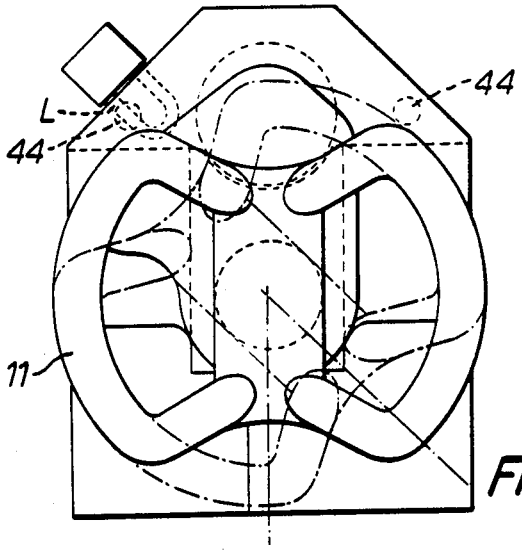

Reference to FIG. 5 shows an arrangement for locking the injection device 1 in the firing position but allowing operation of the isolating valves 8 and 9 and the by-pass valve 10, by permitting the handwheel 11 to make its initial rotation through 45 degrees. To this end, a lock L is fitted to a guide rod 44 behind the female terminal 2.

Figure 6A:
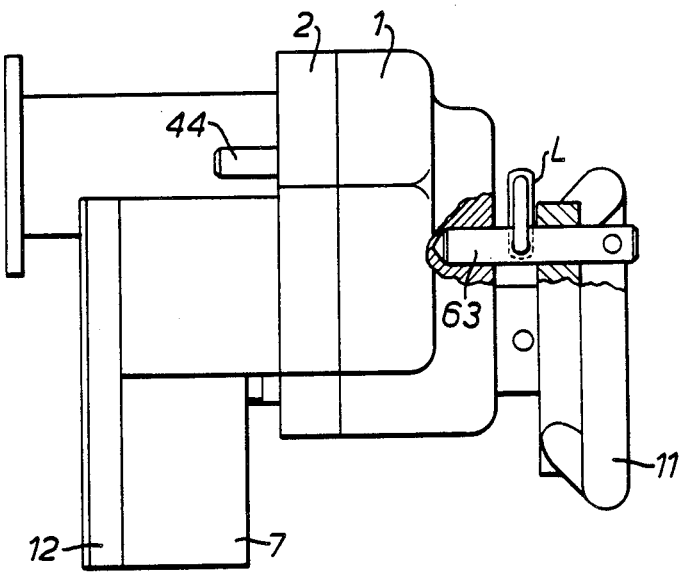
FIGS. 6A and 6B are fragmentary side and end elevations, respectively, of the same fluid injector showing the handwheel padlocked with the fluid injection device in the firing position.
Figure 6B:
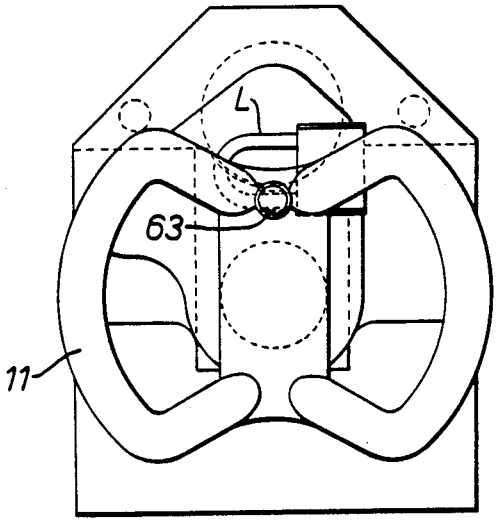

Reference to FIG. 6 shows an arrangement for locking the injection device 1 in the firing position and preventing operation of the valves in the terminal valve block 7, in which a pin 63 is inserted through the handwheel 11 and into the male terminal block 41, and a lock L is fitted to that pin behind the handwheel to prevent its unauthorised withdrawal.

Figure 7A:
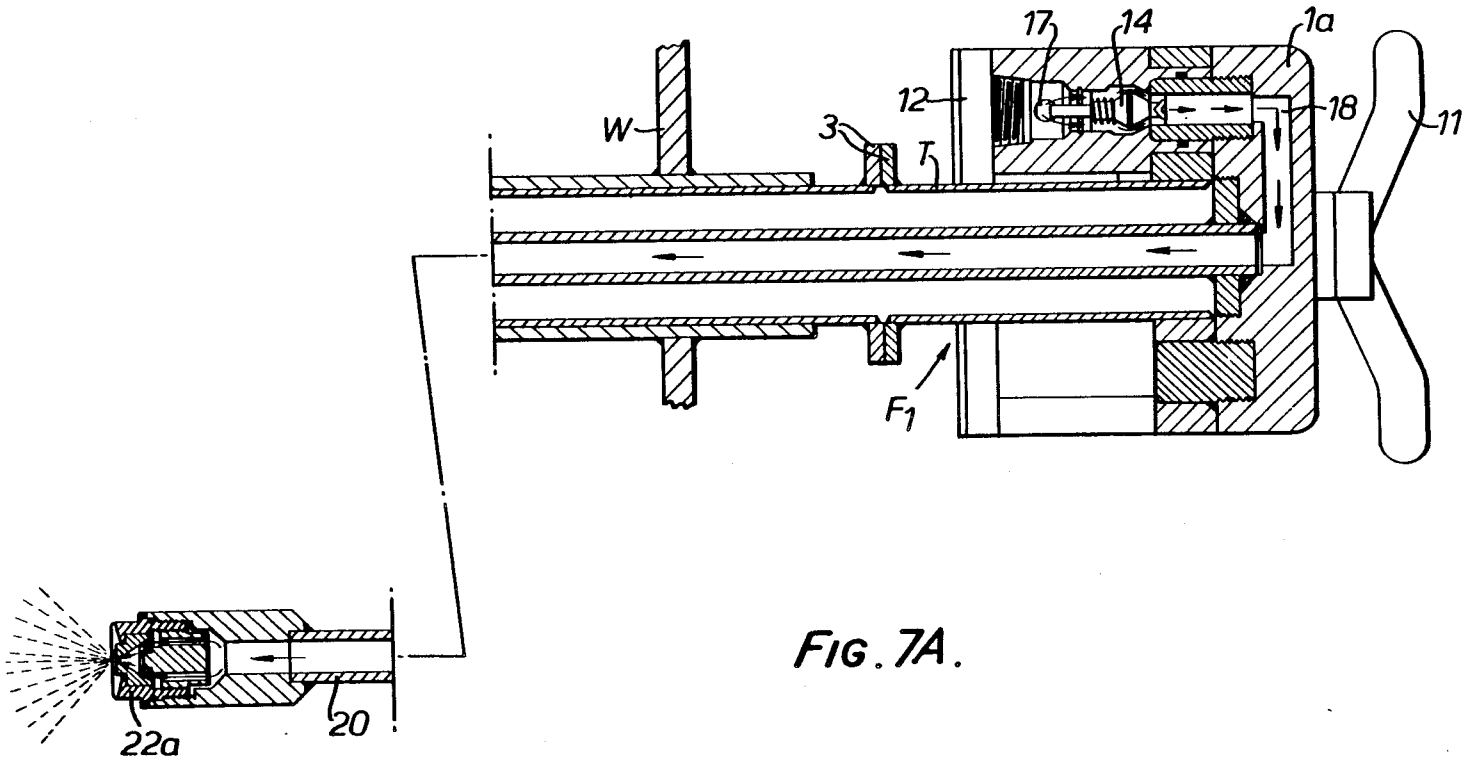
FIGS. 7A, 7B and 7C are a part-sectioned plan view, side elevation and end elevation, respectively, of a pressure jet fluid injector incorporating a positive mechanical interlock.
Figure 7B:
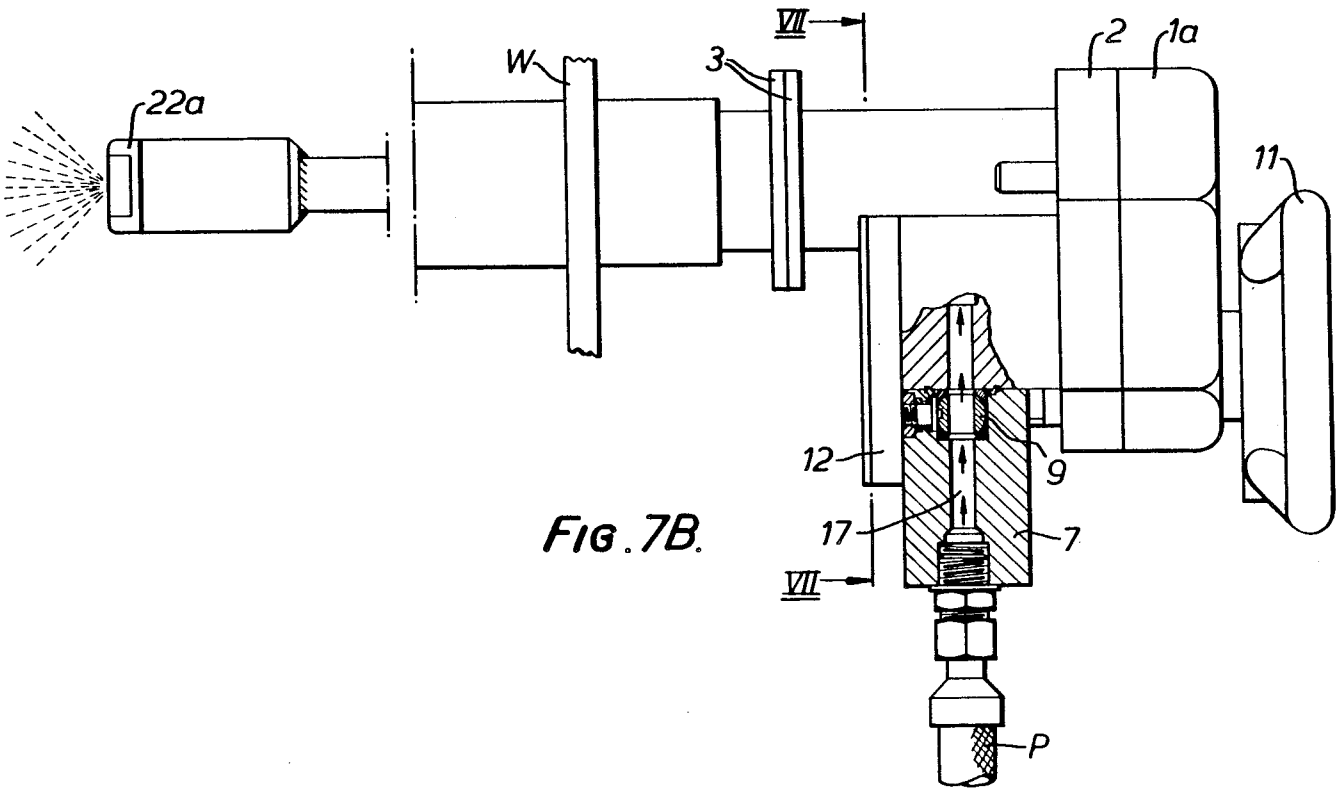
Figure 7C:
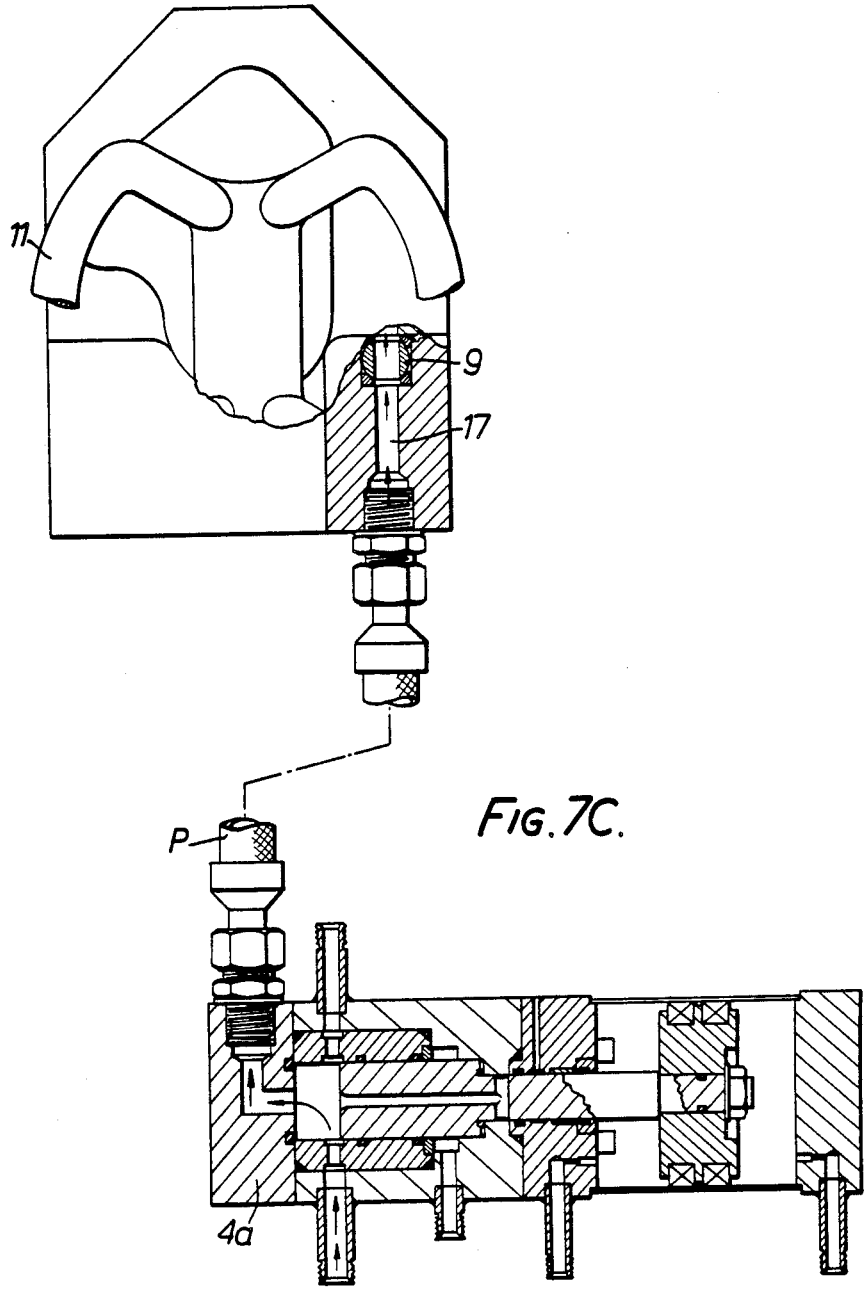
Figure 7D:
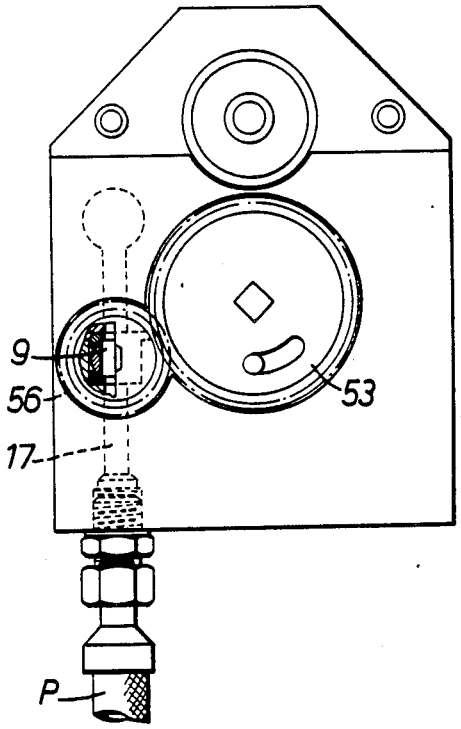
FIG. 7D is a section along line VII—VII of FIG. 7B.
Figure 8A:
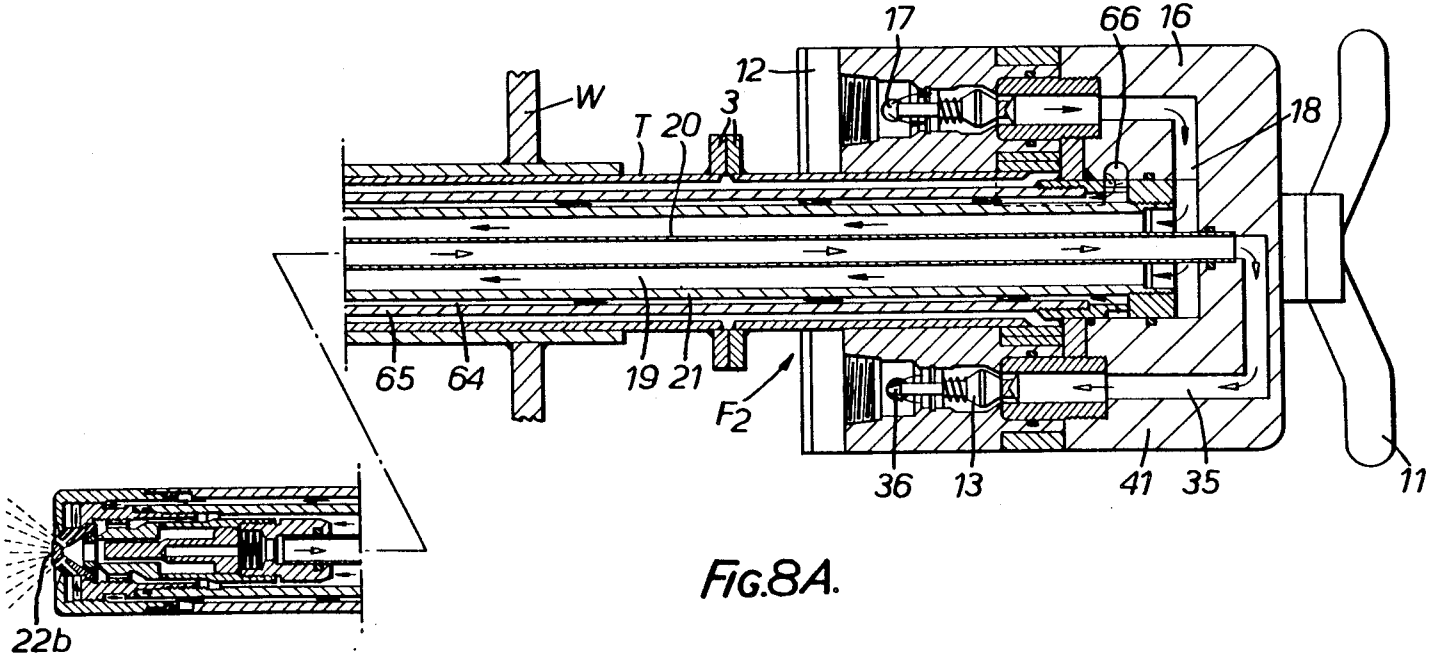
FIGS. 8A, 8B and 8C are a part-sectioned plan view, side elevation and end elevation, respectively of a multi-fluid injector incorporating a positive mechanical interlock.
Figure 8B:
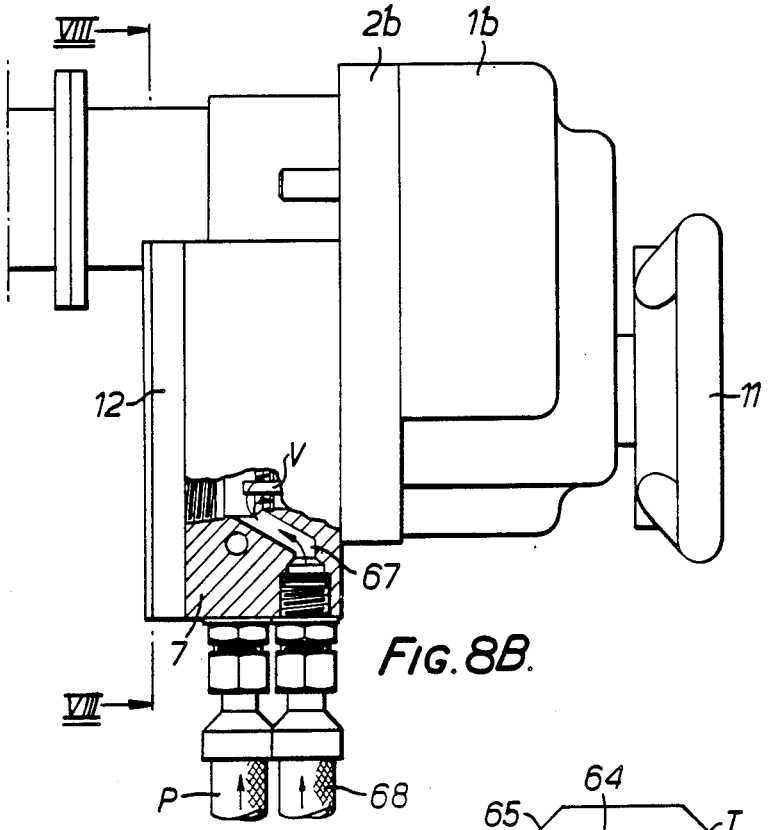
Figure 8D:
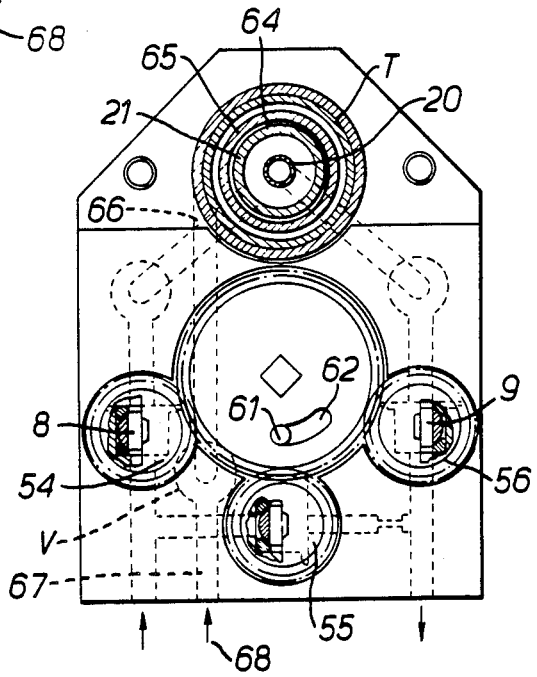
FIG. 8D is a section along line VIII—VIII of FIG. 8B.
Figure 8C:
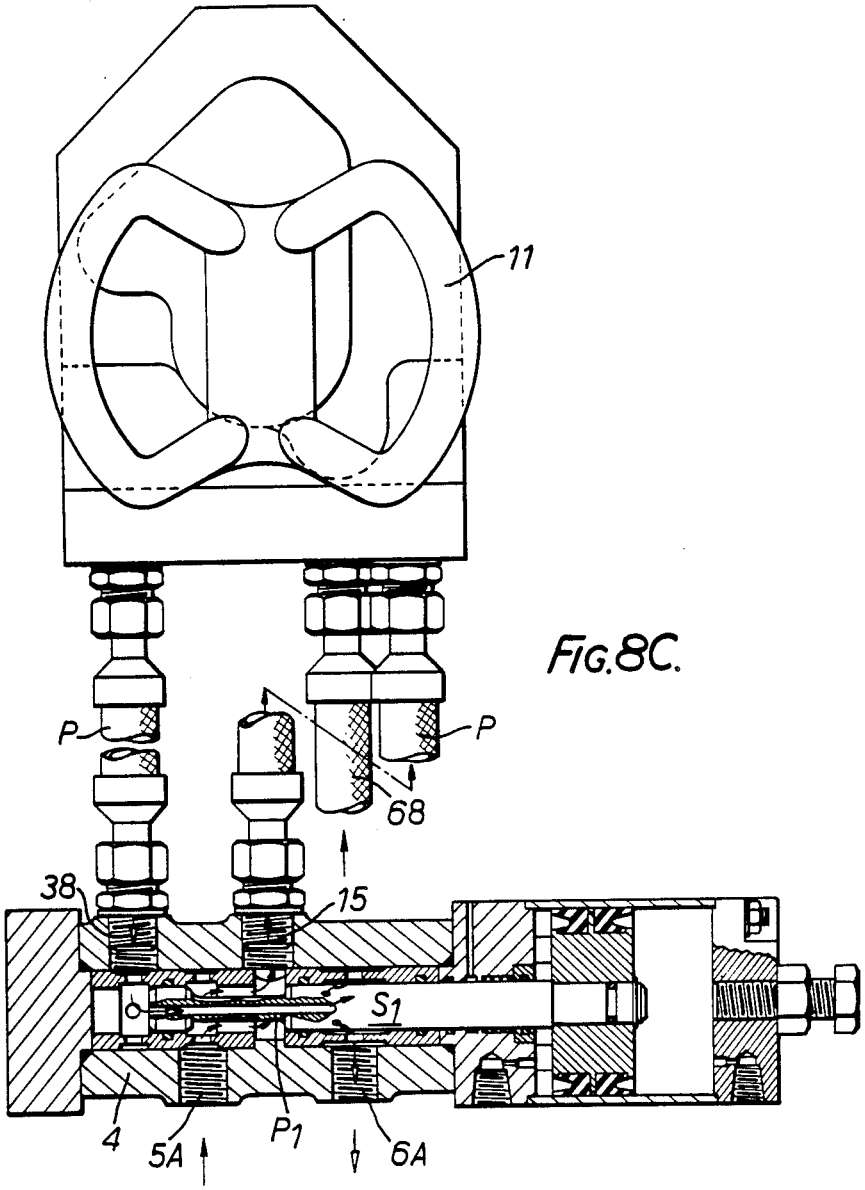
Figure 9A:
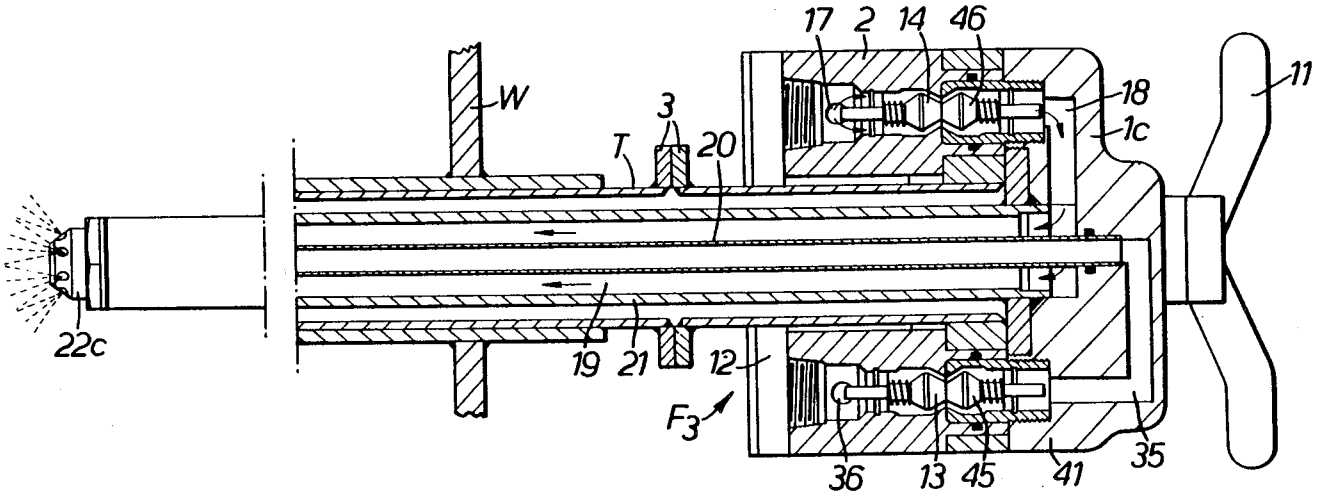
FIGS. 9A, 9B and 9C are a part-sectioned plan view, side elevation and end elevation, respectively, of a second fluid atomised fluid injector.
Figure 9B:
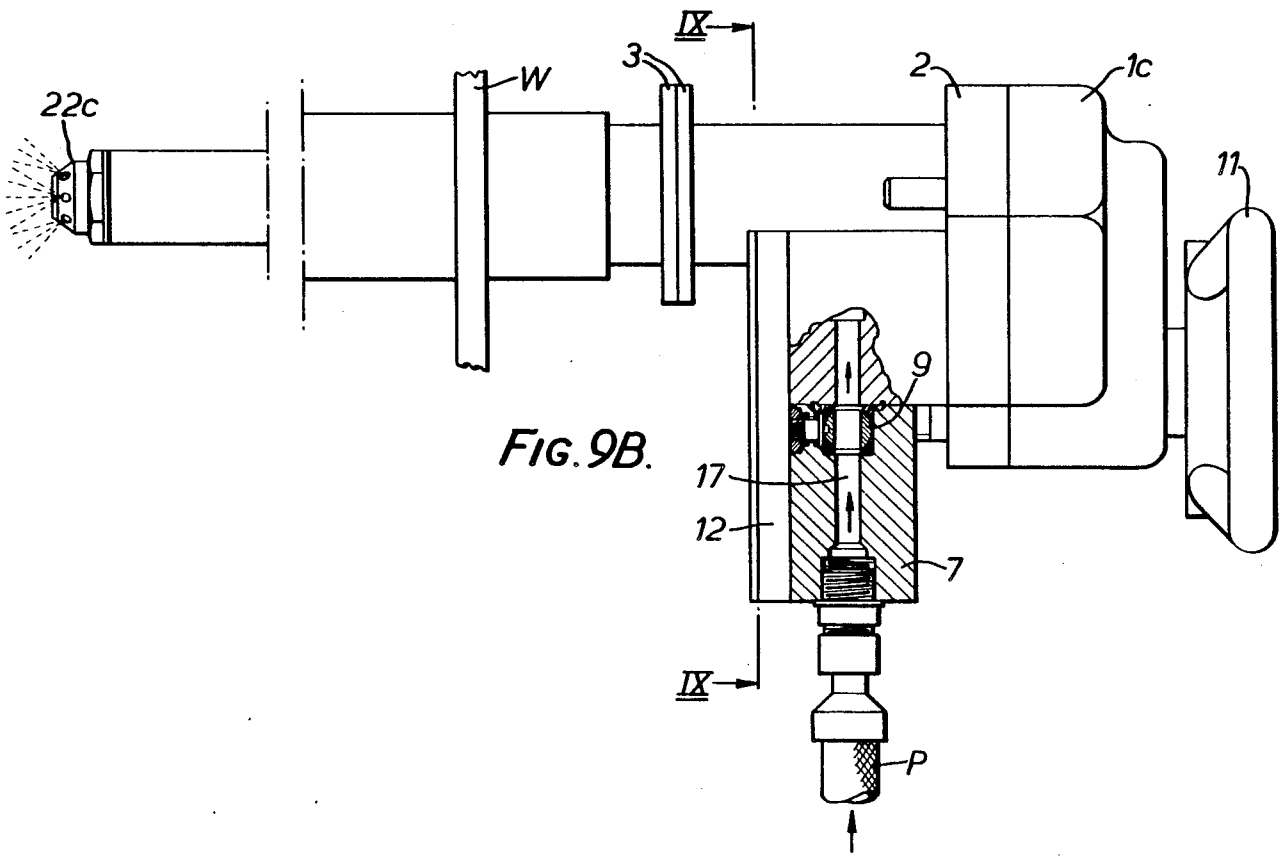
Figure 9C:
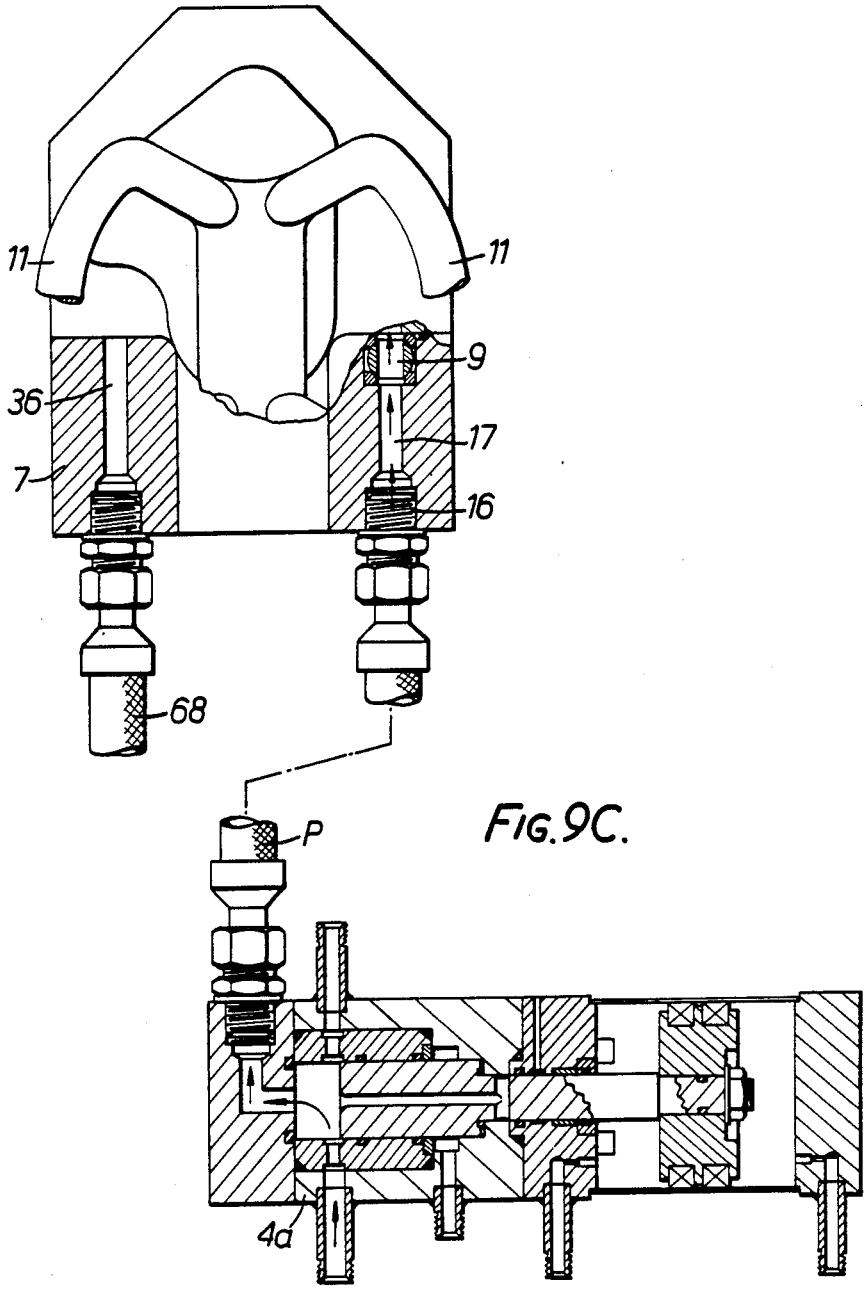
Figure 9D:
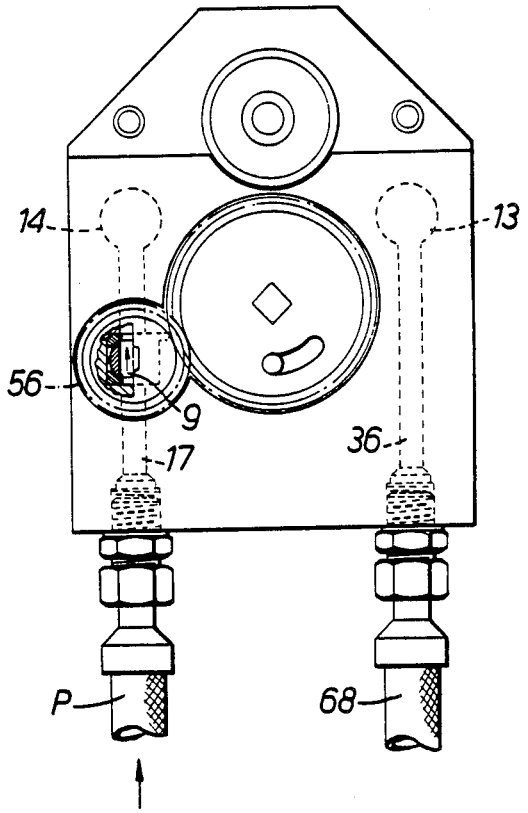
FIG. 9D is a section along line IX—IX of FIG. 9B.

Reference to FIGS. 7A and 7D shows a fluid injector $F_1$ of the pressure jet type with a positive mechanical interlock as previously described albeit modified to the extent that there is no return flow from the fluid atomiser assembly **22*a* of the injection device 1*a*. Hence, only one isolating valve 9 with its operating planet gear 56 is necessary and no by-pass valve 10; "automatic circulation" here occurs only through the operating valve 4a** itself as described in UK-A-2,080,703.

Reference to FIGS. 8A to 8D shows a fluid injector $F_2$ of the multi-fluid kind also with the previously described positive mechanical interlock. The second fluid, which could be steam, is supplied to the fluid atomiser assembly **22*b* of the injector device 1*b* along an annular duct 64 defined between the outer tube 21 and an encompassing tube 65 made fast with the male terminal block. The duct 64 is connected via passages 66, 67 through the male and female terminal assemblies to a steam supply hose 68, and suitable means would be provided, such as a self-sealing valve assembly V, to isolate the steam supply so that it cannot escape from the female terminal when the injection device 1*b*** is withdrawn therefrom.

Reference to FIGS. 9A to 9D shows a fluid injector $F_3$ which is second fluid atomised with a positive mechanical interlock and an operating valve **4*a* similar to those incorporated in the fluid injector $F_1$ of the pressure jet type. Again, there is no return flow of fuel oil from the fluid atomiser 22*c* so that, as before, only one isolating valve 9 with its planet gear 56 is called for, a by-pass valve 10 is not provided, and "automatic circulation" takes place through the operating valve 4*a* as in UK-A-2,080,703. In this embodiment, the second fluid (steam or air are typical) is used to atomise the primary fluid, i.e. the fuel oil, and hence unlike the multi-fluid injector, the second fluid injector does not incorporate a tip valve. Rather, the second fluid delivery is connected by pipe 68 to the terminal block 7 to be ducted via the female terminal duct 36 and the self-sealing valves 13, 45 into the male terminal duct 35 into the central tube 20 of the injection device 1c whilst the fuel oil is ducted via the duct 17, isolating valve 9, self-sealing valves 14, 46 and duct 18 into the annular duct 19 of the injection device, from which to emerge as an atomised spray at the atomiser 22*c***.

It will be appreciated that whilst it is desirable for the fluid injectors F and $F_2$ to incorporate the cross-connecting duct 60 and by-pass valve 10, that these could be dispensed with thereby simplifying the construction of the gearbox 12 so that "automatic circulation" then would only occur through the change-over valve 4 itself.

An oil burner incorporating any of the fluid injectors as described would also have an air register to provide the combustion air, valves to regulate and shut off the air and fuel supplies, and an igniter to initiate combustion.

What is claimed is:

1. A fluid injector comprising:

an injection device;

fluid connection means fluidly connecting said injection device to a fluid delivery line external to said fluid injector, said injection device being removably mounted relative to said fluid connection means;

valve means for controlling fluid communication between said fluid connection means and said injection device;

actuator means, first initial rotary movement of which selectively rotates said valve means to an isolate position so as to fluidly isolate said fluid connection means from said injection device, first continued rotary movement of which in the same rotary direction effects removal of said injection device from said fluid connection means, said first continued rotary movement to effect said removal of said injection device being possible only after completion of said first initial rotary movement to rotate said valve means to said isolate position, second initial rotary movement of which in the opposite rotary direction effects insertion of said injection device relative to said fluid connection means to an operating position, second continued rotary movement of which in said opposite rotary direction rotates said valve means to a position at which said valve means fluidly communicates said fluid connection means with said injection device, said second continued rotary movement to rotate said valve means to its said position at which to fluidly communicate said fluid connection means and said injection device being possible only after completion of said second initial rotary movement to effect said insertion of said injection device to its said operating position;

a gear train means between said valve means and said actuator means, said gear train means being rotatable in response to said first initial rotary movement and said second continued rotary movement of said actuator means to rotate said valve means to its said isolate and communicate positions, respectively; and cam track means associated with said fluid connection means and cam follower means associated with said actuator means, said cam follower means being movable relative to said cam track means in response to said first continued rotary movement and said second initial rotary movement of said actuator means to effect said removal and insertion, respectively, of said injection device from and to its said operating position;

wherein said actuator means includes a rotatable handwheel shaft having a handwheel secured thereto, said cam follower means is fast with said handwheel shaft which is rotatable by said handwheel, said handwheel shaft is axially fast with said injection device, and said cam track means is fashioned on a stationary member of said fluid connection means and is so configured that rotation of said handwheel causes said cam follower means and said handwheel shaft as it rotates to move axially thereby inserting said injection device to, or removing said injection device from, said operating position in dependence on the sense of rotation of said handwheel; and wherein said cam track means leads into a slot formed in a second shaft and into which said cam follower means slides as said handwheel completes its said second initial rotary movement to effect said insertion of said injection device to its said operating position, said second shaft is in driving engagement with said gear train means, said second continued rotary movement of said handwheel engages said cam follower means with said slot to rotate said second shaft and hence said gear train means in one rotary sense to rotate said valve means to its said position to fluidly communicate said fluid connection means with said injection device, said first initial rotary movement of said handwheel engaging said cam follower means with said slot to rotate said second shaft and hence said gear train means in the opposite rotary sense to rotate said valve means to its said isolate position, said cam follower means slides from said slot as said handwheel completes its said first initial rotary movement to be engaged with said cam track means to effect removal of said injection device from its said operating position as said handwheel executes its said first continued rotary movement.

2. A fluid injector as claimed in claim 1, wherein said cam follower means is a drive pin projecting radially from said handwheel shaft in diametrically opposite directions, each radial projection of said drive pin being engageable with an associated said cam track means and slot.

3. A fluid injector as claimed in claim 2, wherein said stationary member has diametrically opposed keyways therein extending from a bore receiving said handwheel shaft and for receiving and guiding said drive pin to and from said cam track means as said injection device is removably mounted relative to said fluid connection means.

4. A fluid injector as claimed in claim 1, including a fluid coupling device comprising a pair of terminals, one of which constitutes said stationary member and the other of which is fast with said injection device, said other terminal rotatably supporting said handwheel shaft, said one terminal supporting said valve means, said gear train means and said second shaft, said other terminal including first flow path means communicating with said injection device, said one terminal including second flow path means for fluid communication with said fluid connection means, said valve means being interposed in said second flow path means to seal off or open same when in said isolate or communicate positions, respectively, said first and second flow path means communicating with each other when said injection device is in said operating position.

5. A fluid injector as claimed in claim 4, wherein said one terminal includes first self-actuated to closure valve means to seal off said second flow path means when said terminals are disconnected from each other upon removal of said injection device from said operating position, said first self-actuated to closure valve means being urged open when said terminals are interconnected upon insertion of said injection device to said operating position to open said second flow path means.

6. A fluid injector as claimed in claim 5, wherein said other terminal includes second self-actuated to closure valve means to seal off said first flow path means when said terminals are disconnected from each other upon removal of said injection device from said operating position, said first and said second self-actuated to closure valve means urging each other open when said terminals are interconnected upon insertion of said injection device to said operating position to communicate said first and second flow path means with each other.

7. A fluid injector as claimed in claim 4, wherein said fluid connection means comprises a flow control valve having a fluid inlet port adapted for connection to said fluid delivery line and a fluid return port adapted for connection to a fluid return line, said flow control valve permitting selective discharge of fluid from said injection device when said injection device is in said operating position.

8. A fluid injector as claimed in claim 7 wherein said injection device includes a discharge passage and a tip valve for controlling discharge through said discharge passage, said flow control valve being movable into one position to condition said tip valve to permit fluid discharge through said discharge passage and into another position to condition said tip valve to close said discharge passage.

9. A fluid injector as claimed in claim 8, wherein said first flow path means comprises first and second flow paths communicating with first and second ducts, respectively, in said injection device, said second flow path means comprises further first and second flow paths, said first and second flow paths of said other terminal being matched with said first and second flow paths of said one terminal, said flow control valve in one of its said positions causing fluid to flow from said inlet port through said matched first flow paths into said first duct towards said discharge passage, said flow control valve in the other of its said positions causing fluid to flow from said inlet port through said matched second flow paths into said second duct to return via said first duct and said matched first flow paths into said return port.

10. A fluid injector as claimed in claim 9, wherein said valve means comprises a pair of valves each interposed in one of said first and second flow paths in said one terminal to seal off or open same when in said isolate or communicate positions, respectively.

11. A fluid injector as claimed in claim 10, including a duct interconnecting said first and second flow paths in said one terminal, and by-pass valve means interposed in said duct, said first-mentioned initial movement of said actuator means moving said by-pass valve means to a position in which said by-pass valve means opens said duct to interconnect said first and second flow paths in said one terminal by which fluid delivered through said inlet port may circulate therethrough to return into said return port, and said second continued movement of said actuator means moves said by-pass valve means to a closed position in which said by-pass valve means seals said duct.

12. A fluid injector as claimed in claim 11, wherein said by-pass valve means is rotated between its open and closed positions and is interconnected by said gear train with said actuator means.

13. A fluid injector as claimed in claim 12, wherein said gear train comprises a sun gear drivingly connected with said second shaft and planet gears, said pair of valves of said valve means and said by-pass valve means each drivingly connected with a respective planet gear.

14. A fluid injector as claimed in claim 13, including means for restricting rotation of said sun gear beyond extreme positions at which in one sense of rotation said valve means are in the isolate position and in the opposite sense of rotation said valve means are in the communicate position.

15. A fluid injector as claimed in claim 8, wherein said one terminal is adapted for connection to a second external fluid delivery line to enable the use of a second fluid to regulate discharge through said discharge passage, said terminals including cooperating valves for communicating the second fluid delivery line with said injection device when said terminals are interconnected and for isolating the second fluid delivery line from said injection device when said terminals are disconnected.

16. A fluid injector as claimed in claim 7, wherein said flow control valve provides a direct flow path through itself intercommunicating said inlet and return ports when said injection device is removed from said operating position by which fluid delivered through said inlet port may circulate through said direct flow path to return into said return port.

17. A fluid injector as claimed in claim 16, wherein said flow control valve comprises a housing having said inlet and return ports and a valve spool linearly movable in said housing to control the direction of fluid flow within said fluid injector, said direct flow path comprising a passage in said valve spool.

18. A fluid injector as claimed in claim 7, wherein said flow control valve is connected by pipe means with said one terminal.

19. A fluid injector as claimed in claim 7, wherein said flow control valve is made integral with said one terminal.

20. A fluid injector as claimed in claim 7, wherein said fluid injector is of the pressure jet type which is mechanically atomised.

21. A fluid injector as claimed in claim 7, wherein said fluid injector is of the pressure jet type which is second fluid atomised, and wherein said first flow path means comprises first and second flow paths communicating with first and second ducts, respectively, in said injection device, said second flow path means comprising a second flow path in said one terminal which is matched with the second flow path in said other terminal, said flow control valve being operative to cause fluid to flow from said inlet port through said matched second flow paths into said second duct towards a discharge passage, and including a first flow path in said one terminal which is adapted for connection to a second external fluid delivery line to pass said second fluid into said first flow path in said other terminal and into said first duct towards said discharge passage to atomise said first-mentioned fluid.

22. A fluid injector as claimed in claim 21, wherein said one terminal includes valve means self-actuated to closure to seal off said first flow path therein when said terminals are disconnected from each other upon removal of said injection device from said operating position, said self-actuated to closure valve means being urged open when said terminals are interconnected upon insertion of said injection device to said operating position to open said first flow path in said one terminal.

23. A fluid injector as claimed in claim 1, including means for locking said injection device against removal from said operating position but permitting said valve means to be moved to said isolate position.

24. A fluid injector as claimed in claim 1, including means for locking said injection device in said operating position and preventing movement of said valve means.

* * * * *

UNITED STATES PATENT AND TRADEMARK OFFICE

CERTIFICATE OF CORRECTION

PATENT NO. : 4,705,330

DATED : November 10, 1987

INVENTOR(S) : David Tindall

It is certified that error appears in the above-identified patent and that said Letters Patent are hereby corrected as shown below:

Column 1, line 38, "and" should read --any--.

Column 2, line 45, "insert" should read --inset--.

Signed and Sealed this

Fifteenth Day of March, 1988

*Attest:*

*Attesting Officer*

DONALD J. QUIGG

*Commissioner of Patents and Trademarks*